US006986234B2

(12) United States Patent
Liedtke

(10) Patent No.: US 6,986,234 B2
(45) Date of Patent: Jan. 17, 2006

(54) SYSTEM AND METHOD FOR BANDOLIERING SYRINGES

(75) Inventor: Klaus Liedtke, Ormond Beach, FL (US)

(73) Assignee: ForHealth Technologies, Inc., Daytona Beach, FL (US)

( * ) Notice: Subject to any disclaimer, the term of this patent is extended or adjusted under 35 U.S.C. 154(b) by 0 days.

(21) Appl. No.: 10/626,506

(22) Filed: Jul. 23, 2003

(65) Prior Publication Data

US 2004/0261358 A1 Dec. 30, 2004

Related U.S. Application Data

(60) Provisional application No. 60/483,531, filed on Jun. 27, 2003.

(51) Int. Cl.
*B65B 13/02* (2006.01)

(52) U.S. Cl. ..... 53/399; 53/582

(58) Field of Classification Search ..... 53/389, 53/582, 398, 419, 443, 444, 446, 137.2, 450, 53/451, 550, 551, 399

See application file for complete search history.

(56) References Cited

U.S. PATENT DOCUMENTS

| | | | |
|---|---|---|---|
| 2,627,470 | A | 2/1953 | Seiferth |
| 2,880,723 | A | 4/1959 | Adams |
| 2,981,432 | A | 4/1961 | Flood |
| 3,527,017 | A | 9/1970 | Taylor et al. |
| 3,611,656 | A | 10/1971 | Childey, Jr. |
| 3,651,615 | A | 3/1972 | Bohner et al. |
| 3,676,271 | A | 7/1972 | Hake et al. |
| 3,736,933 | A | 6/1973 | Szabo |
| 3,823,818 | A | 7/1974 | Shaw |
| 3,835,897 | A | 9/1974 | Gess |
| 3,878,026 | A | 4/1975 | Snyder et al. |
| 3,880,211 | A | 4/1975 | Gess |
| 4,472,357 | A | 9/1984 | Levy et al. |
| 4,502,616 | A | 3/1985 | Meierhoefer |
| 4,512,472 | A | 4/1985 | Jarund |
| 4,512,475 | A | 4/1985 | Federighi |
| 4,624,148 | A | 11/1986 | Averette |
| 4,639,250 | A | 1/1987 | Rycroft |
| 4,674,652 | A | 6/1987 | Aten et al. |
| 4,702,788 | A | 10/1987 | Okui |
| 4,758,230 | A | 7/1988 | Rycroft |
| 4,823,982 | A | 4/1989 | Aten et al. |
| 4,865,592 | A | 9/1989 | Rycroft |

(Continued)

FOREIGN PATENT DOCUMENTS

| | | |
|---|---|---|
| EP | 0042336 | 12/1981 |
| EP | 021800 | 4/1987 |
| EP | 0935969 | 8/1999 |
| WO | WO-98/32690 | 7/1998 |

*Primary Examiner*—John Paradiso
(74) *Attorney, Agent, or Firm*—Darby & Darby

(57) ABSTRACT

The present invention provides an automated system and method of banding (bandoliering) a plurality of syringes. The system includes a feed device for receiving the plurality of syringe barrels and positioning the plurality of syringes according to a predetermined orientation and an indexed device for transferring the plurality of syringes in the predetermined orientation to a transport device that includes individual pockets for receiving and holding the syringes in a spaced relationship as the syringes are advanced due to movement of the transport device. The system also includes a web application device disposed along the transport device for applying a first web material to a first face of a predetermined number of syringes and a second web material to a second face of the syringes and being configured to press the first and second materials into contact with the first and second faces of the syringes, respectively, and into contact with each other in areas between the syringes so as to form a banded syringe structure.

42 Claims, 16 Drawing Sheets

U.S. PATENT DOCUMENTS

| | | | | |
|---|---|---|---|---|
| 5,019,048 | A | | 5/1991 | Margolin |
| 5,188,696 | A | | 2/1993 | Good, Jr. |
| 5,337,636 | A | | 8/1994 | Shea |
| 5,341,854 | A | | 8/1994 | Zezulka et al. |
| 5,356,393 | A | | 10/1994 | Haber et al. |
| 5,573,042 | A | | 11/1996 | De Haen |
| 5,597,530 | A | | 1/1997 | Smith et al. |
| 5,611,430 | A | | 3/1997 | Albrecht et al. |
| 5,651,775 | A | | 7/1997 | Walker et al. |
| 5,704,921 | A | | 1/1998 | Carilli |
| 5,782,157 | A | | 7/1998 | Ellington et al. |
| 5,805,454 | A | | 9/1998 | Valerino, Sr. et al. |
| 5,884,457 | A | | 3/1999 | Ortiz et al. |
| 5,887,722 | A | | 3/1999 | Albrecht et al. |
| 5,893,259 | A | * | 4/1999 | Posge ..... 53/448 |
| 5,911,252 | A | | 6/1999 | Cassel |
| 6,048,086 | A | | 4/2000 | Valerino, Sr. |
| 6,722,404 | B2 | * | 4/2004 | Osborne ..... 141/133 |
| 2002/0020459 | A1 | | 2/2002 | Baldwin et al. |
| 2004/0088951 | A1 | | 5/2004 | Baldwin et al. |

* cited by examiner

SYSTEM AND METHOD FOR BANDOLIERING SYRINGES

CROSS-REFERENCE TO RELATED APPLICATION

This application claims the benefit of U.S. provisional application Ser. No. 60/483,531, filed Jun. 27, 2003, entitled System and Method for Bandoliering Syringes, which is hereby incorporated by reference in its entirety.

TECHNICAL FIELD

The present invention relates generally to the handling of syringes, and more particularly, to an automated system and method for preparing a batch of joined syringes by a banding (e.g., bandoliering) operation.

BACKGROUND

Disposable syringes are in widespread use for a number of different types of applications. For example, syringes are used not only to withdraw a fluid (e.g., blood) from a patient but also to administer a medication to a patient. In the latter, a cap or the like is removed from the syringe and a unit dose of the medication is carefully measured and then injected or otherwise disposed within the syringe.

As technology advances, more and more sophisticated, automated systems are being developed for preparing and delivering medications by integrating a number of different stations, with one or more specific tasks being performed at each station. For example, one type of exemplary automated system operates as a syringe filling apparatus that receives user inputted information, such as the type of medication, the volume of the medication and any mixing instructions, etc. The system then uses this inputted information to disperse the correct medication into the syringe up to the inputted volume.

In some instances, the medication that is to be delivered to the patient includes more than one pharmaceutical substance. For example, the medication can be a mixture of several components, such as several pharmaceutical substances.

By automating the medication preparation process, increased production and efficiency are achieved. This results in reduced production costs and also permits the system to operate over any time period of a given day with only limited operator intervention for manual inspection to ensure proper operation is being achieved. Such a system finds particular utility in settings, such as large hospitals, that require a large number of doses of medications to be prepared daily. Traditionally, these doses have been prepared manually in what is an exacting but tedious responsibility for a highly skilled staff. In order to be valuable, automated systems must maintain the exacting standards set by medical regulatory bodies, while at the same time simplifying the overall process and reducing the time necessary for preparing the medications.

Because syringes are often used as the carrier means for transporting and delivering the medication to the patient, it is advantageous for these automated systems to be tailored to accept syringes. However, the previous methods of dispersing the medication from the vial and into the syringe were very time consuming and labor intensive. More specifically, medications and the like are typically stored in a vial that is sealed with a safety cap or the like. In conventional medication preparation, a trained person retrieves the correct vial from a storage cabinet or the like, confirms the contents and then removes the safety cap manually. This is typically done by simply popping the safety cap off with ones hands. Once the safety cap is removed, the trained person inspects the integrity of the membrane and cleans the membrane. An instrument, e.g., a needle, is then used to pierce the membrane and withdraw the medication contained in the vial. The withdrawn medication is then placed into a syringe to permit subsequent administration of the medication from the syringe.

Typically, the medication is placed in the syringe when the needle is in place and secured to the barrel tip by drawing the medication through the needle and into the syringe barrel. Such an arrangement makes it very difficult for this type of syringe to be used in an automated system due to the fact that medication is drawn through the small needle into the syringe barrel and therefore this operation is a very time and labor intensive task. What is needed in the art and has heretofore not been available is a system and method for automating the medication preparation process and more specifically, an automated system and method for preparing a syringe including the automated removal, parking, and replacement of a tip cap of the syringe.

Over the years, automated systems have been proposed to prepare batches of syringes that are interconnected in some manner so that the syringes can be fed to another apparatus for further processing of the syringes. In other words, the syringes can be fed in an automated manner to an apparatus that then prepares and delivers prescribed contents (medication) to the syringe. For example, U.S. Patent Application Publication No. 2002/0020459 discloses an apparatus for handling a plurality of syringe bodies which are interconnected to one another by a belt such that the syringe bodies lie in a predetermined orientation, with a predetermined spacing therebetween. This particular apparatus is configured such that a first tape is fed to a wheel which receives and holds syringe bodies in notches formed therein. The first tape is placed in contact with the syringe bodies so that the syringe bodies contact the adhesive side of the first tape and are therefore adhesively secured thereto. As the wheel rotates, it carries the syringes in contact with the first tape to a position where the syringes come into contact with an adhesive side of a second tape, which is simultaneously being unwound from a roll. In this manner, the first and second tapes get adhered to diametrically opposite sides of the syringes. The syringes are then fed to a press wheel that rotates to press the tape strips to each other between the syringes. The syringes are positioned in the band or belt (i.e., the joined first and second tapes) in a common orientation, i.e., with the luers of all the syringes on the same side of the band. While, this particular apparatus is satisfactory for its intended purpose, the apparatus suffers from a number of deficiencies. For example, the syringe bodies are first adhesively secured to one tape and then brought into contact with another tape before the two tapes are pressed together around the syringe bodies. Thus, because the first and second tapes are fed at different stations and contact the syringe bodies at different times, there is a chance that the first and second tapes can become misaligned resulting in the two tapes not perfectly seating against one another.

Thus, what is needed is an alternative way of handling syringes and more particularly, an apparatus and method of bandoliering syringes using an automated system.

SUMMARY

The present invention provides an automated system and method of banding (bandoliering) a plurality of syringes.

The system includes a feed device for receiving the plurality of syringe barrels and positioning the plurality of syringes according to a predetermined orientation and an indexed device for transferring the plurality of syringes in the predetermined orientation to a transport device that includes individual pockets for receiving and holding the syringes in a spaced relationship as the syringes are advanced due to movement of the transport device. The system also includes a web application device disposed along the transport device for applying a first web material to a first face of a predetermined number of syringes and a second web material to a second face of the syringes and being configured to press the first and second materials into contact with the first and second faces of the syringes, respectively, and into contact with each other in areas between the syringes so as to form a banded syringe structure.

In one exemplary embodiment, the first and second web materials are single side adhesive tapes. Both the indexed device and the transport device have individual pockets or receiving areas for holding and retaining a single syringe during the advancement of the syringe to the web application device with the spacing of the transport device corresponding to the spacing between the syringes in the final banded structure. The present system is configured so that two web materials are simultaneously applied to the opposite faces of the syringes and otherwise brought into a banded construction.

Further aspects and features of the exemplary bandoliering system and method disclosed herein can be appreciated from the appended Figures and accompanying written description.

DETAILED DESCRIPTION OF PREFERRED EMBODIMENTS

Figure 1:
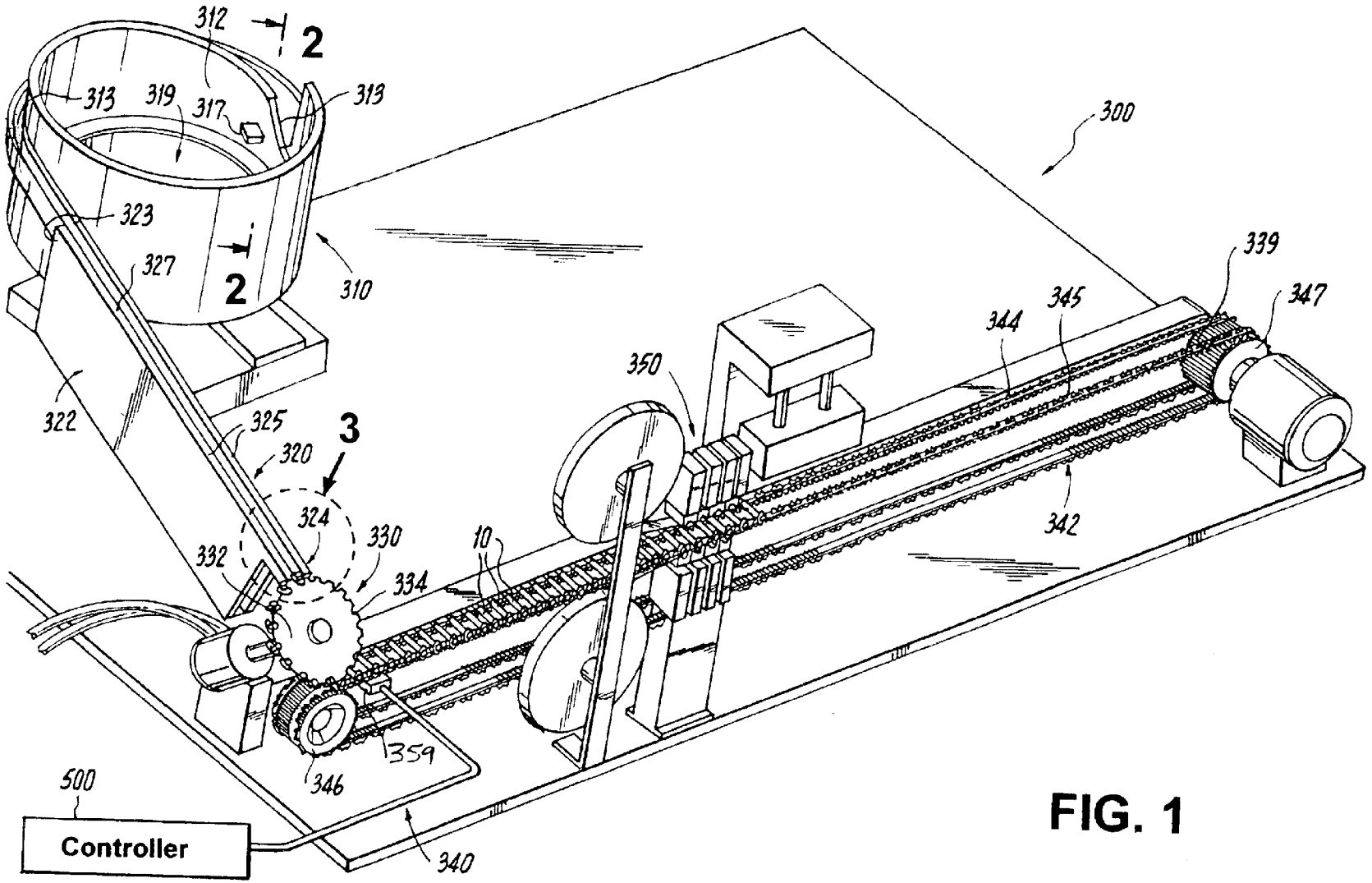
FIG. 1 is a perspective view of an automated system for handling a plurality of syringes using a bandoliering operation to form a banded syringe structure.

Referring to FIGS. 2–14, in which the banded syringe station 110 (FIG. 14) is illustrated in greater detail. As best shown in the perspective view of FIG. 1, the station 110 includes an automated system 300 for receiving, orientating, and banding a plurality of syringes 10 together in a predetermined arrangement so that the syringes 10 can be stored in an interconnected manner or can be transported to another location, such as the first station 120 (FIG. 14) where the syringes 10 are further processed. Thus, the syringes 10 can be banded at one location and then transported to another location where the syringes 10 receive medication and are ready for use and more particularly, the banded syringes 10 can be delivered to the automated system 100 of FIG. 14; or the banded syringes 10 can be packaged in an empty condition for later processing and use.

The exemplary system 300 is defined by a number of stations where one or more specific operation is performed at each station as the syringes 10 are received and then manipulated so that a syringe bandolier is formed. For example, the system 300 includes a syringe feed station 310 where loose syringes are initially fed; a first transport station 320 that receives syringes 10 from the feed station 310 after the syringes 10 have been orientated in a desired way and then delivers them to an index station 330; a second transport station 340 receives the syringes 10 from the index station 330 and then delivers the syringes 10 in an ordered fashion to a web application station 350, where a web material is applied to the syringes 10 to form the banded syringe structure. The banded syringe structure (syringe bandolier) is then transported to another location where it is further processed.

The syringe feed station 310 is generally a station where a number of loose syringes 10 are fed into a syringe feeder device 312. The syringes 10 can be fed into the syringe feeder device 312 without worrying about their orientation and therefore, a number of syringes 10 can be dumped into a receiving section of the syringe feeder device 312 so long as the feeder device 312 is not overfilled. The syringe feeder device 312 is of the type that receives a number of items or parts (e.g., syringes 10) and then through operation thereof arranges the items in a desired orientation so that the items can be fed to the next station at a controlled rate and in the desired orientation.

One exemplary syringe feeder device 312 is a centrifugal bowl feeder that is configured to feed the syringes 10 at a controlled rate and in a desired orientation to the next station. Conventional centrifugal bowl feeders can be used in the present system and each includes an opening or the like that receives items in a bulk state and forms an entrance to a bowl surface (central reservoir) 319 that receives the items in a random orientation. Typically, the bowl surface 319 has a generally conical shape; however, the precise shape and construction of the centrifugal bowl feeder is not critical so long as it can perform its intended function. The centrifugal bowl feeder is designed to propel the syringes 10 around the outer peripheral edge of the bowl feeder by means of centrifugal force. The centrifugal bowl feeder 312 includes a feed track 313 formed on the outer peripheral edge thereof and includes tooling for orientating and segregating the syringes 10 prior to delivering the syringes 10 to the next station. In other words, through centrifugal force generated by movement of the bowl feeder 312 and the design of the orientation tooling, the syringes 10 are orientated in a desired manner as they advance along the feed track 313. There are also features that are formed as part of the feedtrack to cause misorientated items to fall back into the reservoir so that these items can then be reorientated.

Figure 2:
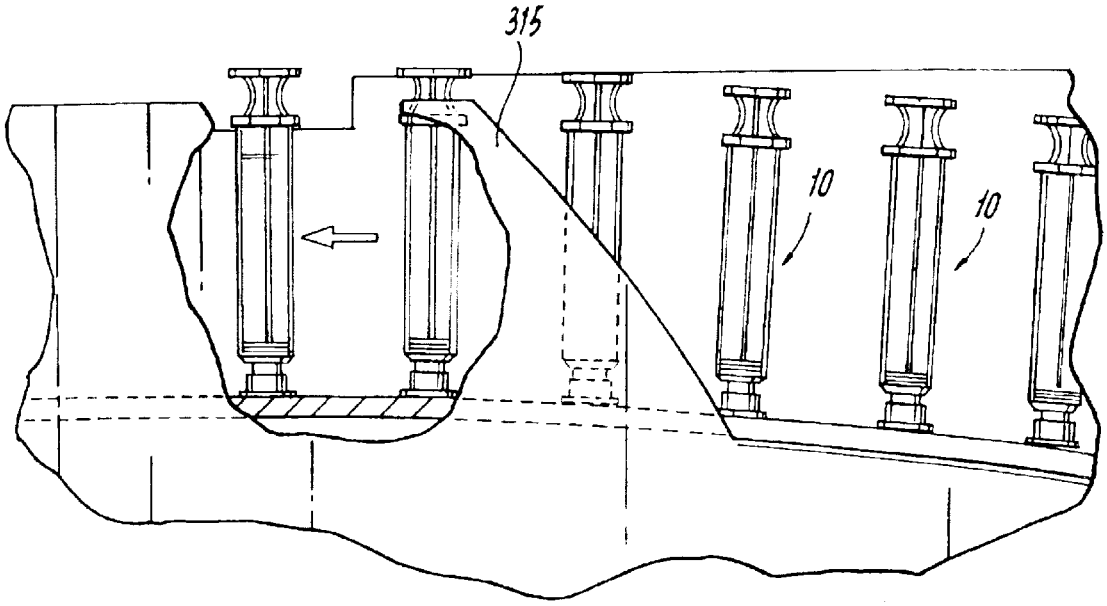
FIG. 2 is a cross-sectional view taken along the line 2—2 of FIG. 1.

The exemplary feed track 313 of the syringe feeder device 312 illustrated in FIGS. 1 and 2 is in the form of a guide rail that is disposed around the peripheral outer wall of the bowl and the feed track 313 is not orientated in a planar manner but rather it rises along the peripheral outer wall to an exit mechanism 315 that causes the syringes 10 to exit the feeder device 312 in the preferred orientation (e.g., upright with the plunger being located at the top). In the exemplary cylindrical feeder device 312, the feed track 313 has a spiral orientation.

Because of its bowl-like configuration, the syringe feeder device 312 has a generally annular shape and includes a feeder discharge (exit port) formed as part of the exit mechanism 315 along an outer periphery thereof to permit the syringes 10 to exit the reservoir once the syringes 10 have been arranged in the desired orientation by the orientation tooling. The exit mechanism 315 includes a device 317 to facilitate the discharge of the syringes 10 from the feed track 313 such that the syringes 10 are delivered to the first transport station 320 in an orderly manner and in the desired orientation. One exemplary device 317 is a device that directs a fluid toward the syringes 10 to cause the syringes to transfer from the feeder device 312 to the first transport station 320. For example, a stream of air can be generated and directed to the syringes 10 in a prescribed direction to cause the syringes 10 to exit through the exit mechanism 315 to the first transport station 320. In other words, the device 317 disengages the syringes 10 from the feed track 313 and directs them to the first transport station 320. If the syringes 10 are not orientated in a proper position, the syringes 10 bypass the exit mechanism 315 and continue to advance along the feed track 313.

Figure 3:
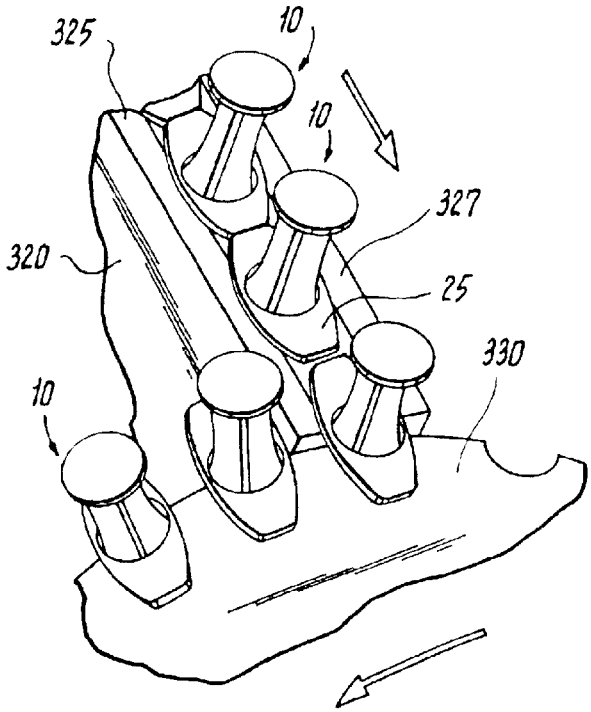
FIG. 3 is an enlarged perspective view of the interaction between the feed mechanism and a rotary dial for advancing the syringes onto a transportation mechanism that advances the syringes to a web application station.

As illustrated in FIGS. 1–3, the orientated syringes 10 are delivered from the syringe feeder device 312 to the first transport station 320 that delivers the syringes to another downstream station. The first transport station 320 includes a first transport mechanism 322 that has a first end 323 that is operatively connected to the syringe feeder device 312 and a second end 324 that is operatively connected to the index station 330.

Any number of different first transport mechanisms 322 can be used so long as the mechanism is designed to receive the syringes 10 in the desired orientation and segregated manner and then deliver the syringes 10 to the next downstream station. One exemplary first transport mechanism 322 is a feeder rail that has a drive feature for advancing the syringes 10 from the first end 323 to the second end 324, while maintaining the syringes 10 in their desired orientation. The feeder rail 322 can be an in-line track that with a straight line drive unit that is designed to produce linear vibratory motion that acts to covey parts horizontally from the feeder discharge located at or proximate the first end 323 to the second end 324 where the syringes 10 are then delivered to another station. The feeder rail 322 accepts only syringes that are properly positioned (e.g., orientated upright with the plunger facing up).

For example, one exemplary feeder rail 322 has a pair of opposing side walls 325 that are spaced apart from one another a sufficient distance so that the syringes 10 can be received between the side walls 325. The feeder rail 322 has a top surface 327 that is defined by an uppermost section of each of the side walls 325. While the syringe bodies can be disposed between the opposing side walls 325, the syringe 10 is constructed so that the barrel flange 25 has dimensions greater than the distance between the side walls 325 so that the barrel flange 25 creates an interference fit between the feeder rail 322. In other words, the width or diameter of the barrel flange 25 is greater than the distance between the side walls 325 so that syringes 10 are suspended in an upright position as a result of the barrel flange 25 seating against and on the top surface 327 of the feeder rail 322. Because of the difference in dimensions between the two members, the syringes 10 are prevented from falling between the side walls 325 and therefore are securely held and maintained in the upright position with the plunger 50 extending above the feeder rail 322. In other words, the syringes 10 are hung on their barrel flanges 25 (i.e., finger grippers) and then advanced in a horizontal direction along the length of the feeder rail 322.

The linear vibratory motion that is imparted to the feeder rail 322 causes the hanging syringes 10 to advance the length of the feeder rail 322 from the first end 323 to the second end 324. The syringes 10 are advanced sequentially (in-line) along the feeder rail 322 one after another as a result of the vibratory motion which in effect causes the syringes 10 to push each other forward from the first end 323 to the second end 324. When device 317 is a device which generates air, the air causes the properly orientated syringes 10 to be transferred from the syringe feeder device 312 to the feeder rail 322 as a result of the air disengaging the syringes 10 from the feed track 313 and directing them into engagement with the feeder rail 322.

Figure 3A:
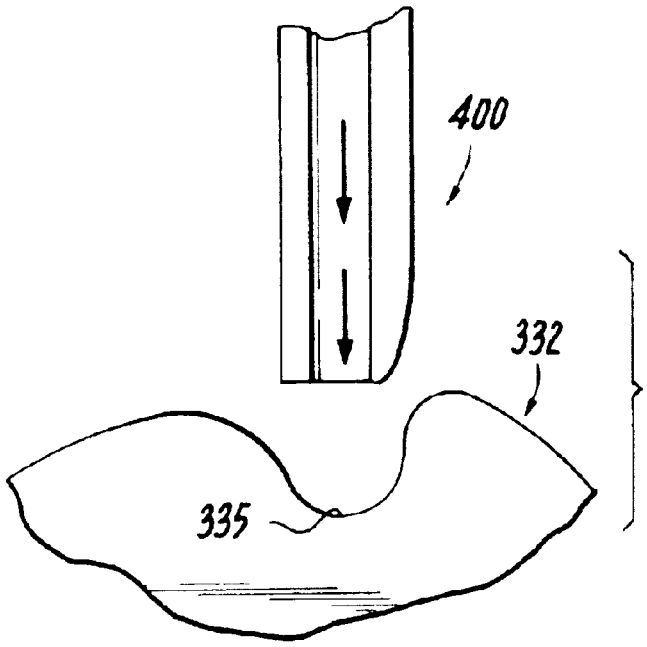
FIG. 3A is a top plan view of the interface between the feed mechanism and the rotary dial with a mechanism for assisting the transfer of the syringes.
Figure 6A:
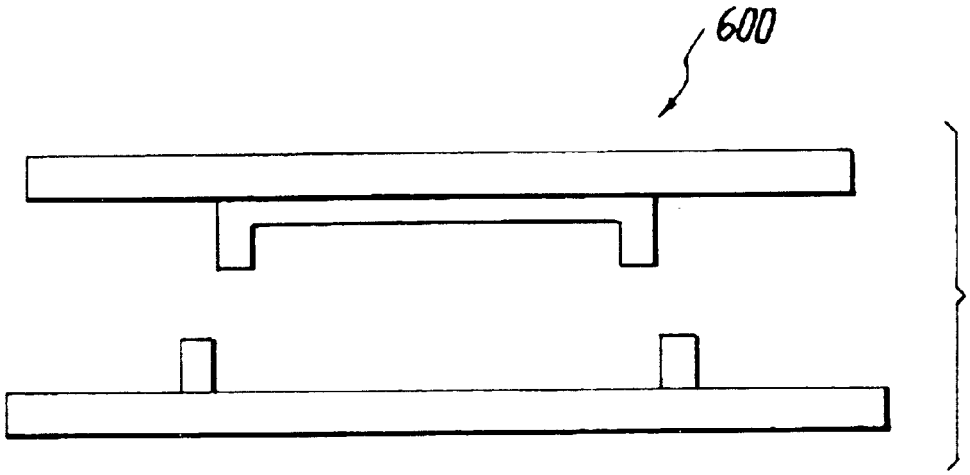
FIG. 6A is a side elevation view of an exemplary tape guide.
Figure 4:
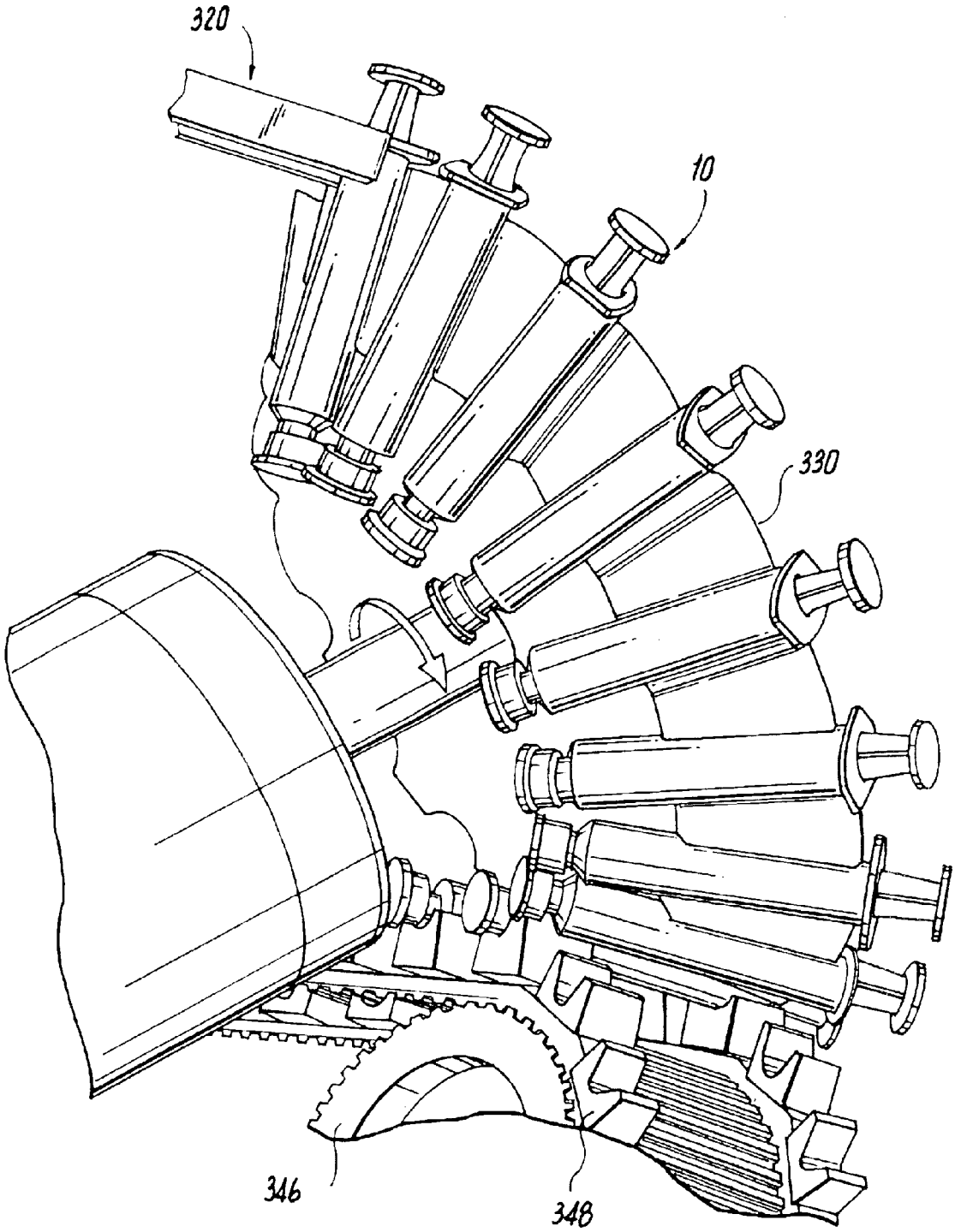
FIG. 4 is an enlarged perspective view showing the transfer of syringes from the rotary dial to a transport mechanism that delivers the syringes to a web application station.
Figure 5:
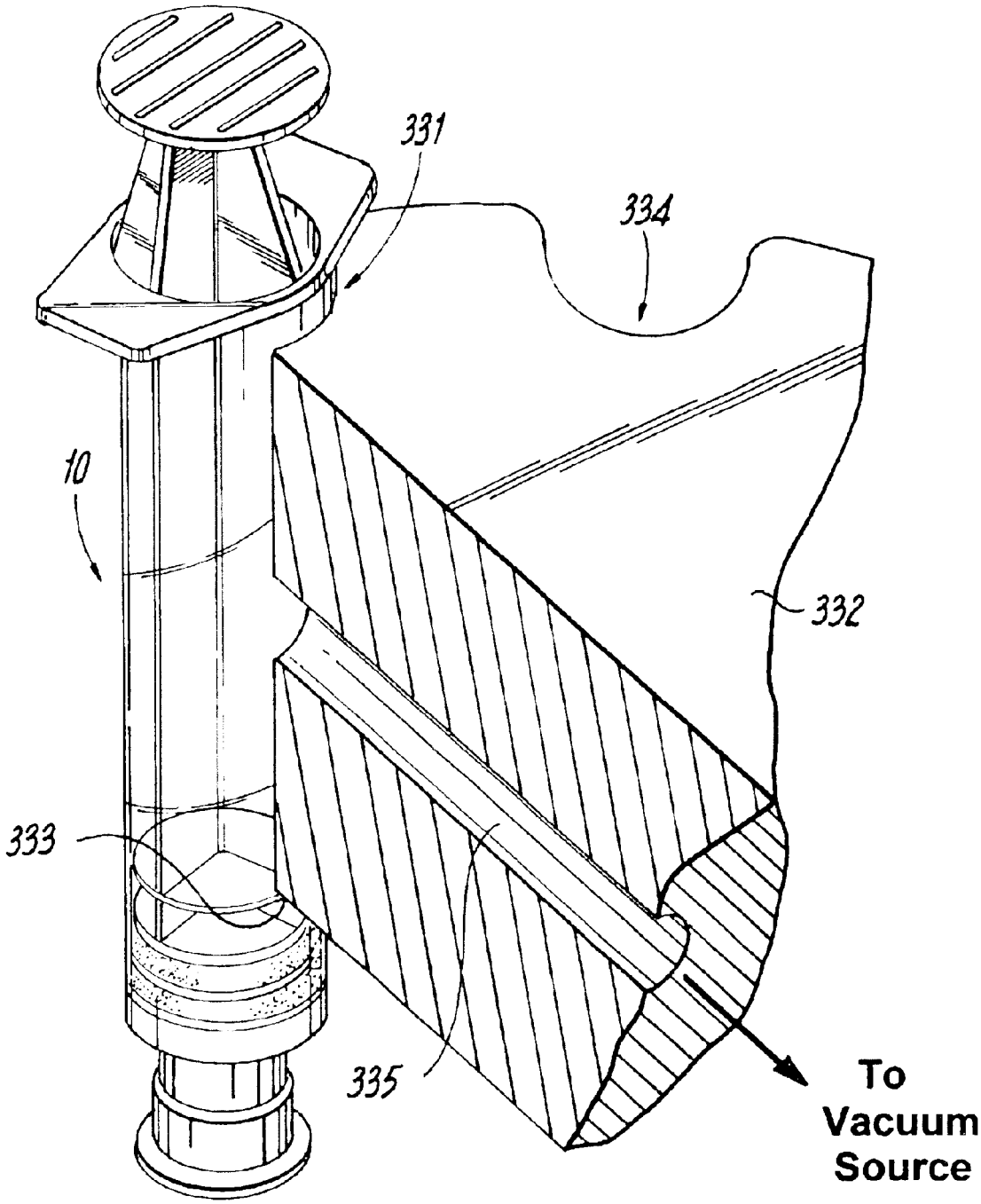
FIG. 5 is an enlarged perspective view in partial cross-section of the rotary dial illustrating vacuum means for retaining the syringe thereon.
Figure 6:
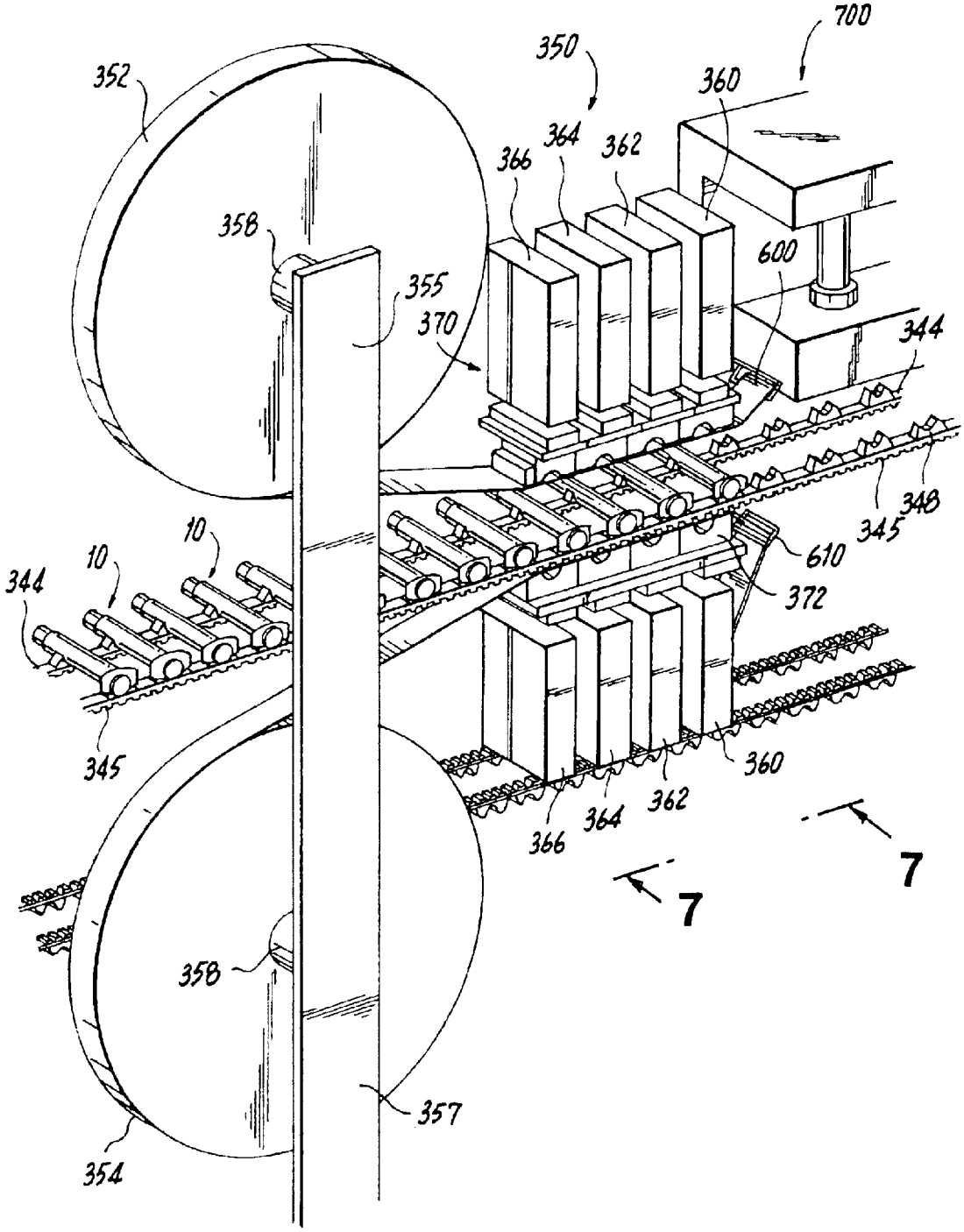
FIG. 6 is a perspective view of the web application station illustrating a tape applicator mechanism in a first position.
Figure 7:
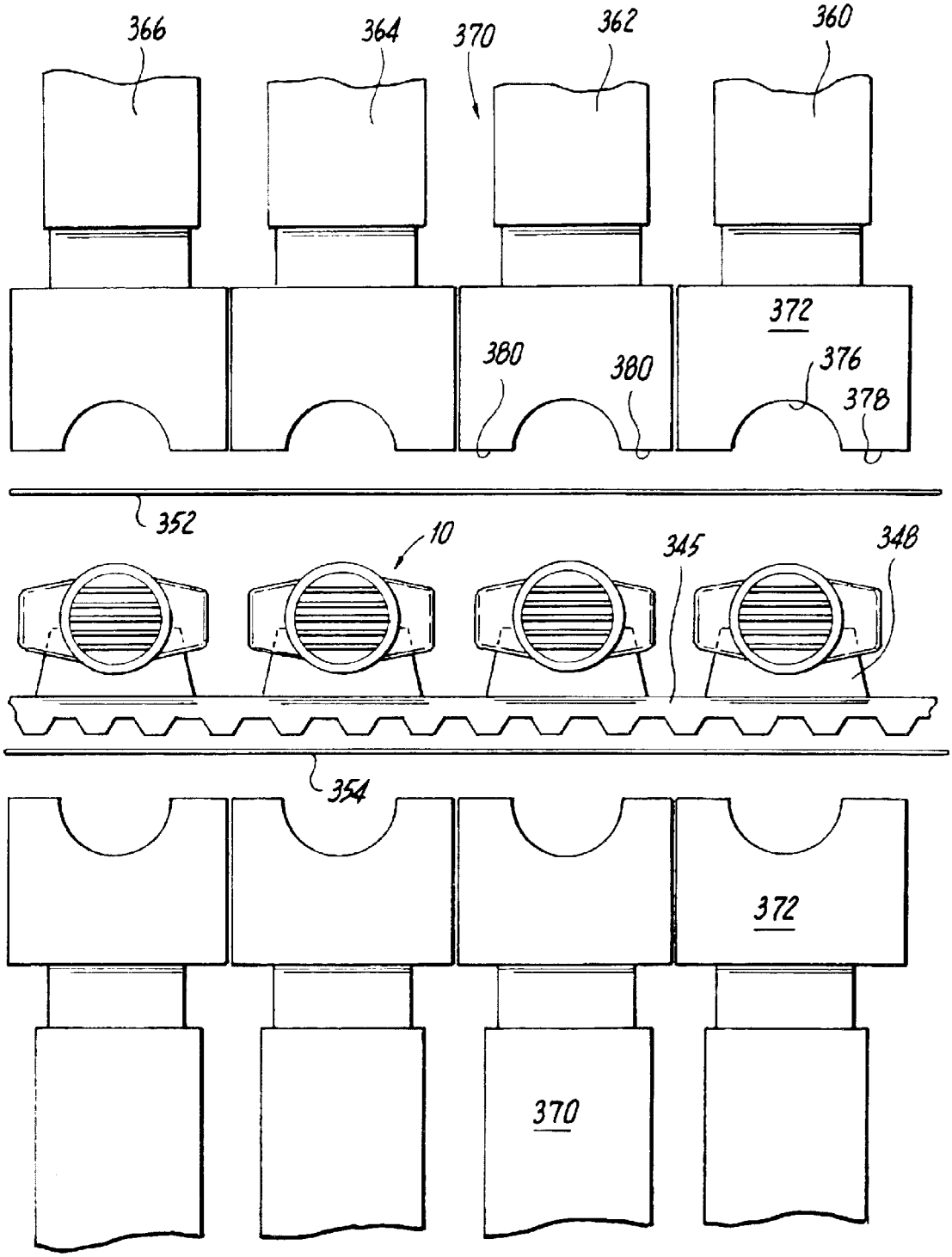
FIG. 7 is a side elevation view of the web application station illustrating the tape applicator mechanism in a rest position.
Figure 8:
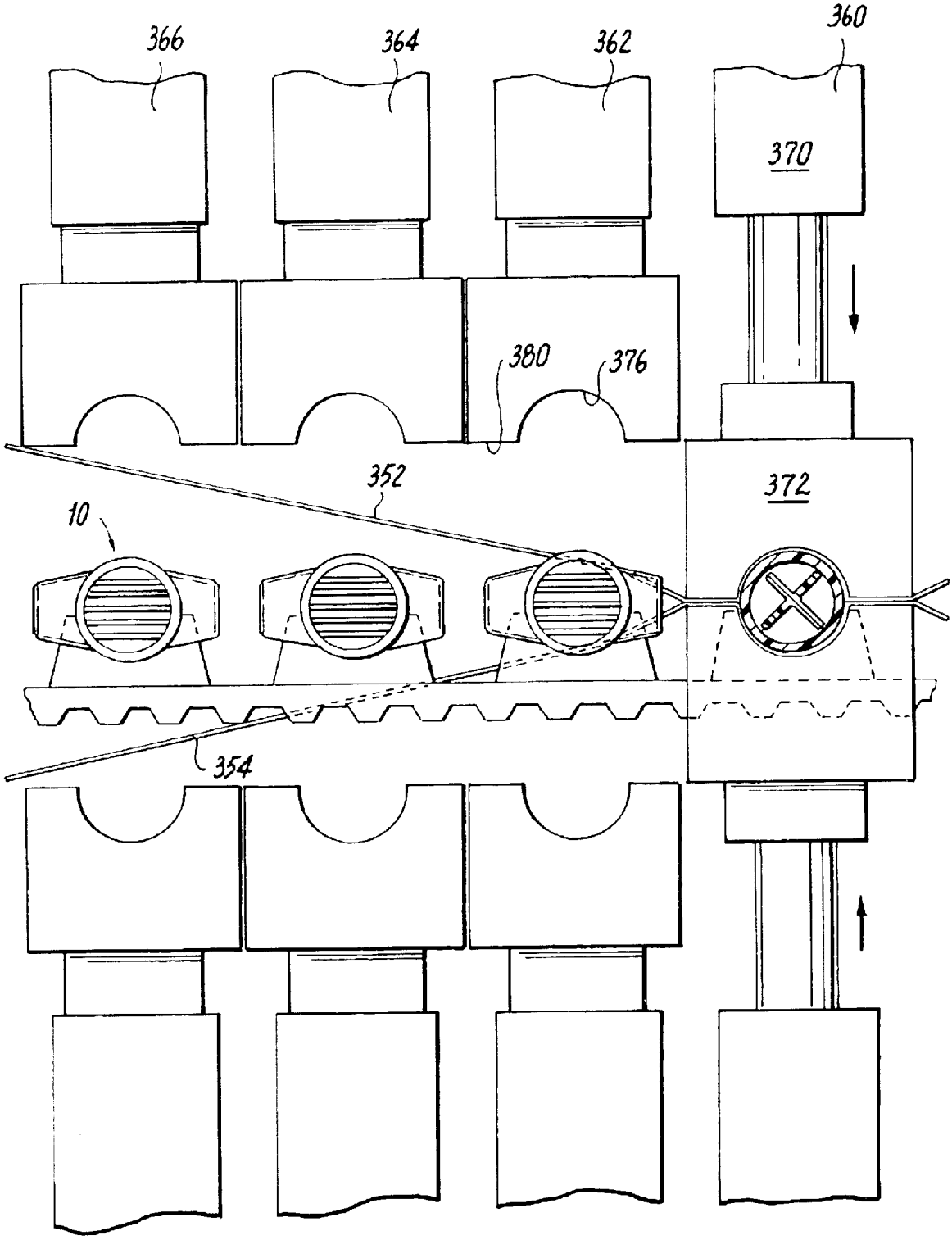
FIG. 8 is a side elevation view of the web application station illustrating the tape applicator mechanism in a first position.
Figure 9:
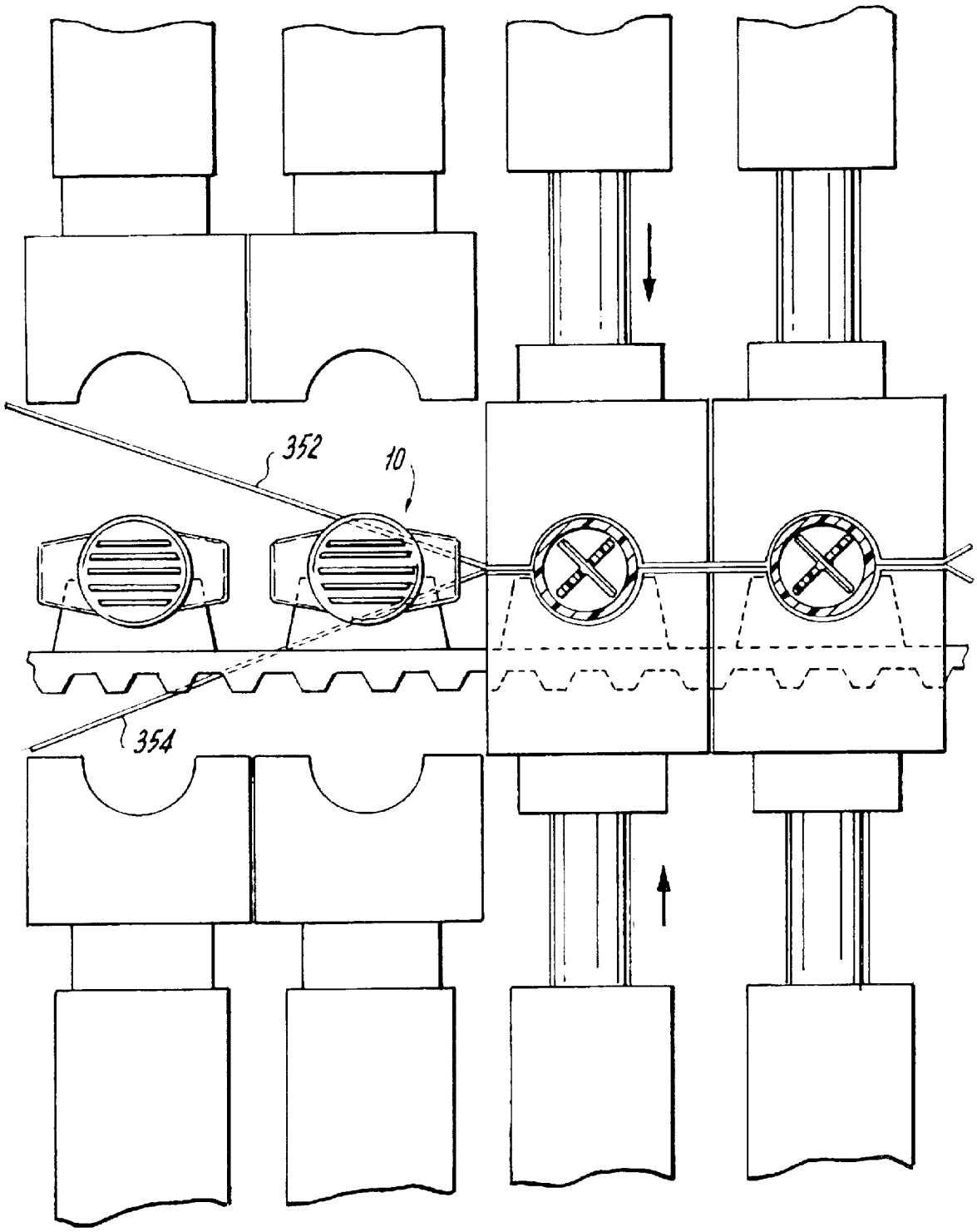
FIG. 9 is a side elevation view of the web application station illustrating the tape applicator mechanism in a second position.
Figure 10:
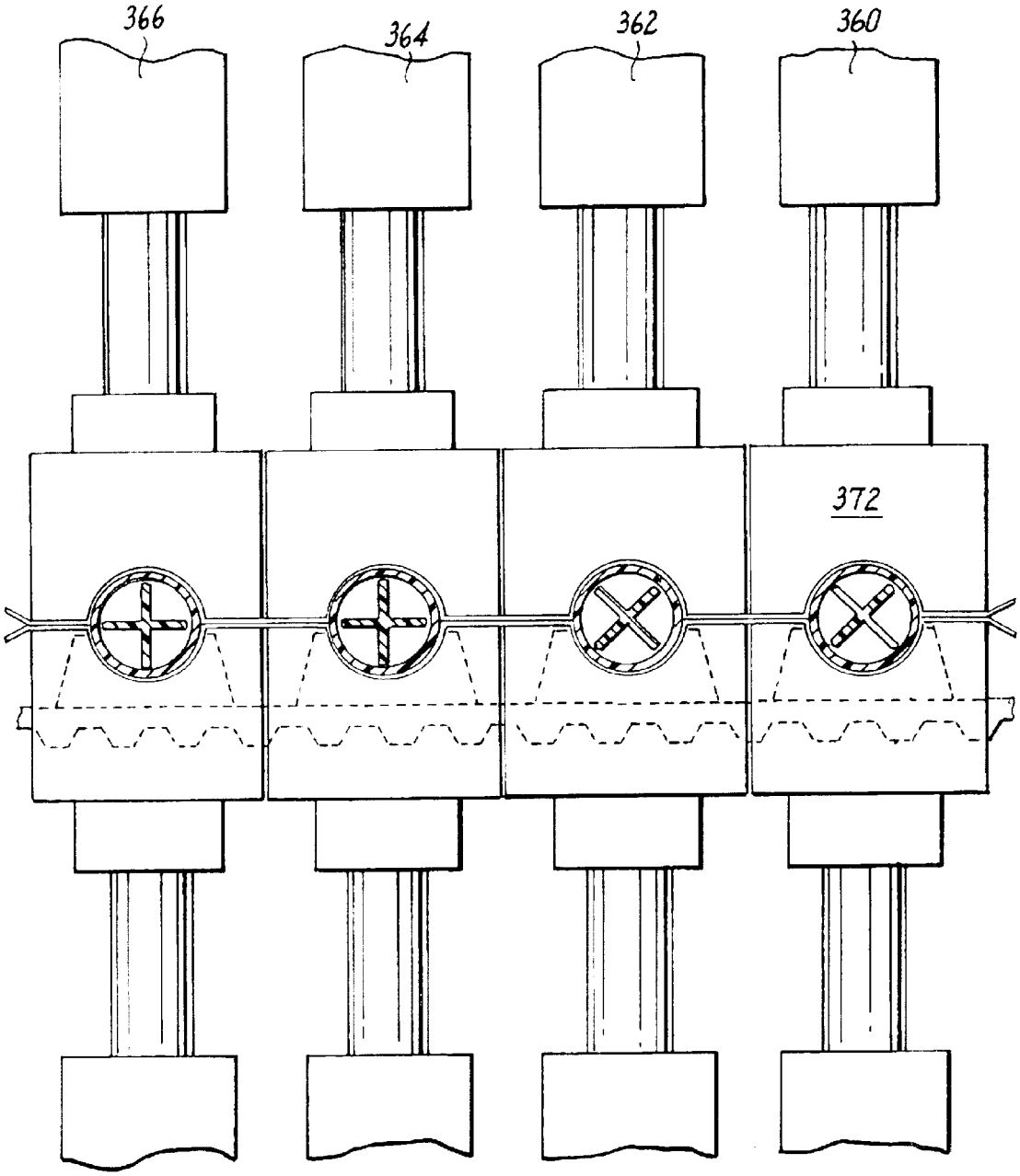
FIG. 10 is a perspective view of the web application station illustrating the tape applicator mechanism in a fully extended position.
Figure 11:
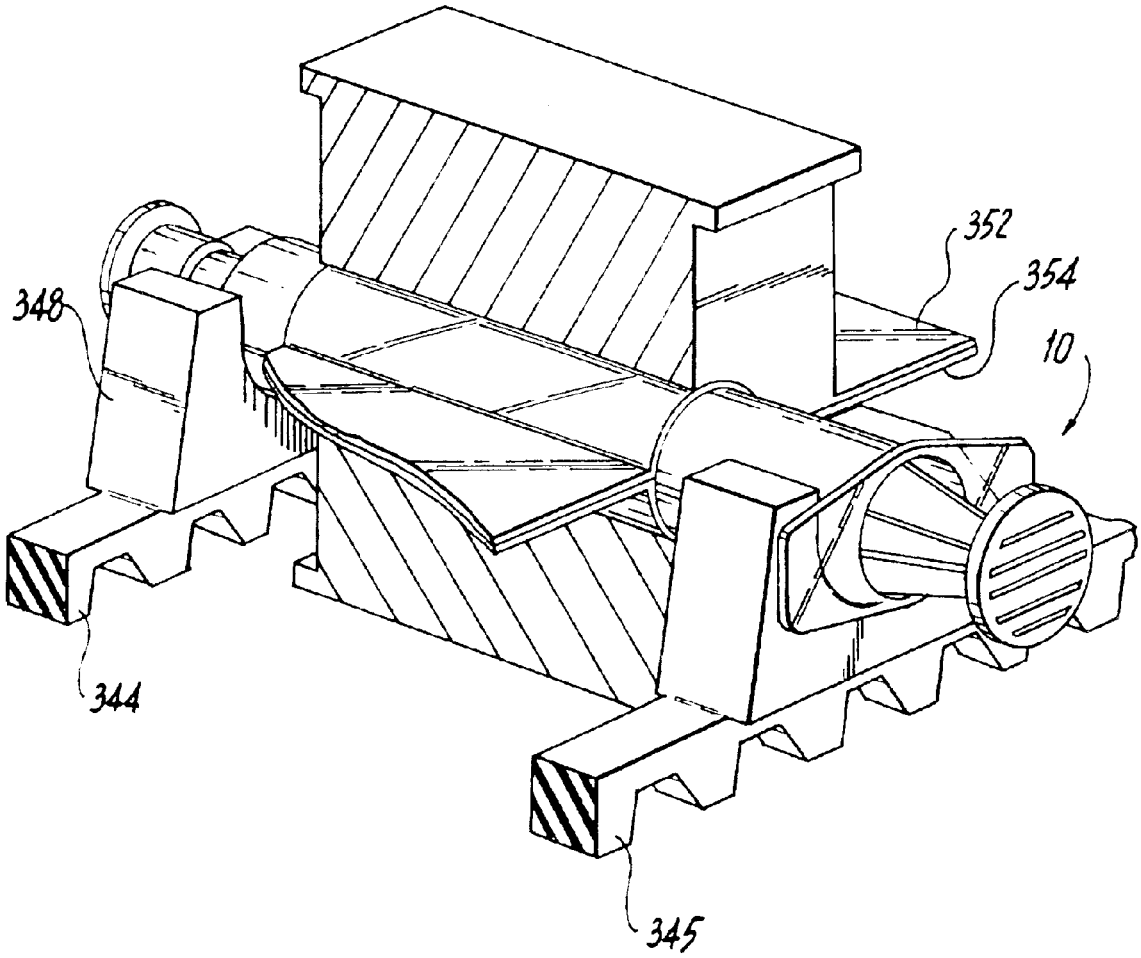
FIG. 11 is a perspective view in partial cross-section illustrating the pressing and banding of the two web materials about the syringe.

The first transport station 320 preferably includes a mechanism 400 (FIG. 3A) for properly positioning the syringe 10 into a guide receiving feature formed as part of the index station 330. Referring to FIGS. 1 and 5, the index station 330 includes a rotary dial 332 that has a number of guide receiving grooves 334 that are formed radially around the outer periphery of the rotary dial 332. More specifically, the rotary dial 332 has a first face 331 and an opposing second face 333 with the grooves 334 extending on the outer peripheral edge from the first face 331 to the second face 333. The rotary dial 332 is mounted so that it is angled relative to the second end 324 of the feeder rail 322, with the grooves 334 facing the second end 324.

The rotary device 332 is actually a vacuum rotary device in that the syringes 10 are held within the grooves 334 by action of a vacuum which is applied to the rotary device 332. The outer peripheral edge of the rotary dial 332 has a number of vacuum ports 335 formed therein and more particularly, the vacuum ports 335 are formed in the grooves 334 so that when the vacuum is applied, negative pressure is formed within the grooves 334 to draw and retain the syringes 10 within the grooves 334 as the dial 332 is advanced. Each groove 334 has a shape that is complementary to the shape of the syringe barrel so that the syringe barrel nests within the groove 334 when it is directed therein. Further details and the operation of the vacuum dial 332 are described below.

One exemplary mechanism 400 is a scrapper plate that positions one syringe 10 into one groove 334 of the dial 332. The scrapper plate is a spring loaded (biased) device that has a receiving feature with a complementary shape so that it sequentially receives and engages one syringe 10 at a time from the second end 324 of the feeder rail 322. The spring loaded nature of the scrapper plate applies a force to the syringe 10 in a direction toward the vacuum dial 332 to cause the syringe 10 to be pushed into the groove 334 while ensuring that the syringe 10 is received in the groove 334 in its proper orientation (e.g., barrel flange 25 above and adjacent the first face 331). Once the force is applied to the syringe 10 and the syringe 10 is directed into the groove 334, the scrapper blade is biased back to its original start position, where it receives another syringe 10 and the process is repeated.

The scrapper plate and the vacuum dial 332 are indexed relative to one another and preferably are both controlled by a master programmable controller so that the scrapper plate is advanced when the groove 334 of the vacuum dial 332 is orientated in its proper position to receive the syringe 10 within the groove 334. Thus, as the scrapper plate is retracted back to the start position, the vacuum dial 332 is advanced to a next position such that the next groove 334 is orientated adjacent the scrapper plate. Accordingly, an open groove 334 is properly positioned so that the scrapper plate can be advanced resulting in a force being applied to the syringe 10 causing the syringe 10 to be pushed into the groove 334.

The vacuum source is actuated so that the vacuum is applied to the vacuum dial 332 at least in the grooves 334 that are to receive and retain syringes 10. The vacuum source is of a sufficient strength to securely hold the syringe 10 within the groove 334 even as the vacuum dial 332 is rotated and the position of the syringe 10 is varied relative to the surrounding components and the ground surface. Preferably, the programmable controller and the vacuum dial 332 are of the type that permit the vacuum ports in individual grooves 334 to be controlled so that the vacuum source in particular grooves 334 can be either turned on or turned off. The vacuum dial 332 is therefore advanced in an indexed manner to permit additional syringes 10 to be received within the grooves 334 of the index dial 332.

In the exemplary embodiment, the vacuum dial 332 is advanced in a clockwise direction; however, it will be understood that the system can be configured so that the vacuum dial 332 rotates in the opposite direction. As the vacuum dial 332 rotates, the syringes 10 held within the grooves 334 by the applied vacuum are advanced in a direction toward the next station, namely the second transport station 340.

The second transport station 340 acts to receive the syringes 10 from the vacuum dial 332 and then advance the syringes 10 to the tape application station 350, while maintaining a predetermined distance between adjacent syringes 10. In one exemplary embodiment, the second transport station 340 includes a conveyor or drive belt 342 for transporting the syringes 10 along a linear horizontal path to the downstream tape application station 350. The conveyor 342 is actually formed of two spaced endless belts 344, 345 that are disposed around and driven by two drive rollers 346, 347 that are spaced apart a predetermined distance. As is known, each endless belt 344, 345 is fitted around the drive rollers 346, 347 so that a first section of the endless belt acts as an upper surface that faces the vacuum dial 332 and a second section of the endless belt acts as a bottom surface that faces an opposite direction. The conveyor 342, its components, and its operation are conventional and therefore are not described in great detail. For example, the drive rollers 346, 347 preferably are in the form of wheels, where at least one of the wheels is operatively coupled to a respective drive shaft (partially shown) which in turn is operatively connected to a motor or other type of drive unit that permits the controlled advancement of the endless belts 344, 345. The drive rollers 346, 347 can include features formed as a part thereof for securely engaging the endless belts 344, 345 so that it can be advanced without slippage. The endless belt 344 is disposed at or near one edge of the rollers 346, 347, while the other endless belt 345 is disposed at or near another, opposite edge of the rollers 346, 347 with a space 339 being defined between the endless belts 344, 345.

As shown in the illustrated embodiment, the endless belts 344, 345 have a plurality of syringe locating and retaining members 348 that are formed as part thereof and are spaced along the endless belts 344, 345. These members 348 are spaced at a predetermined distance from one another so that the syringes 10 are spaced a predetermined, desired distance from each other. In other words, the distance between any two members 348 is the same to ensure that the distance between adjacent syringes 10 is the same. The distance between the grooves 334 of the vacuum dial 332 is thus equal to or substantially equal to the distance between the members 348.

According to one exemplary embodiment, the members 348 are a pair of fingers that are that spaced apart from one another and are constructed to receive one syringe 10 in a nested manner. More specifically, the endless belt 344 has a plurality of spaced members 348 and the endless belt 345 has a plurality of spaced members 348 that are arranged so that the members 348 on the two belts 344, 345 are arranged in pairs. In other words, the pairs of members 348 are axially aligned with respect to one another so that one member 348 of the pair receives the syringe barrel 20 at a location proximate the tip cap 40 and the other member 348 receives the syringe barrel 20 at a location proximate the barrel syringe 25.

Each finger that forms a part of the member 348 is formed of two vertical walls that are spaced apart from one another and are preferably slightly angled relative to one another so that the two vertical walls have a generally V-shape, with the distance between the open tops of the vertical walls being greater than a distance between the lower sections of the vertical walls. Alternatively, each member 348 can be a single integral member that has a contoured groove formed therein to receive the syringe 10 in a nested manner. The fingers are therefore configured to cradle the syringe barrel 20 after it is received from the vacuum dial 332. When the syringe 10 is inserted into the fingers, the barrel flange 25 extends beyond the pair of fingers and seats approximately thereagainst. The center region between the two fingers corresponds generally to where the center of the barrel flange 25 should rest and therefore the distance between the center regions of the two fingers is preferably equal to the distance between the centers of adjacent syringes 10.

The vacuum dial 332 is positioned relative to the belts 344, 345 and more particularly, relative to the members 348, such that as the vacuum dial 332 advances with the syringes 10 captured therein, the syringes 10 are sequentially introduced into open pockets formed by the members 348. The syringe body 20 is thus fed into the pocket (between the fingers) from above as the vacuum dial 332 is advanced and because the movements of the vacuum dial 332 and the belts 344, 345 are coordinated, the members 348 are properly positioned relative to at least one of the grooves 334 of the vacuum dial 332 to receive one syringe 10. Because the belts 344, 345 are driven by the same drive unit, the belts 344, 345 are driven at the same speed and therefore, the opposing pairs of members 348 remain in alignment and do not become misaligned relative to one another when the belts 344, 345 are advanced.

As previously mentioned, the vacuum dial 332 is part of a programmable system such that the vacuum source can be controlled to either activate or deactivate the vacuum ports within particular, select grooves 334. By deactivating the applied vacuum within a selected groove 334, the syringe 10 within this particular groove 334 is no longer held by the vacuum and therefore, the syringe 10 is free to be withdrawn with little or no force.

The system 300 also preferably includes a sensor device 359 for detecting the presence of a syringe 10 relative to a receiving pair of fingers 348. The sensor device 359 is in communication with a controller 500 and is configured to send a signal to the controller 500 when the syringe 10 is in its proper orientation proximate the pair of receiving fingers 348. The proper orientation of the syringe 10 will vary depending upon the construction and placement and orientation of the vacuum dial 332 relative to the second transport device 340; however, it is generally a position where the syringe 10 lies above the pair of fingers 348 so that when the vacuum source is deactivated, the syringe 10 is already within the boundaries of the fingers 348 and it falls only a small distance within the fingers 348 to its resting position. For example, one exemplary sensor device 359 is mounted as part of the second transport device 340 and is of the type that emits a beam such that when the syringe 10 impinges the beam due to it being brought into position within the fingers 348, the sensor device 360 sends a signal to the controller indicating the detection of the syringe 10 in the pocket defined by the pair of fingers 348.

One exemplary sensor device 359 is disposed along at least one of the belts 344, 345 and is configured to emit a light beam or the like. The sensor device 359 is preferably located between one of the pairs of fingers 348 such that normal advancement of the vacuum dial 332 causes one of the syringes 10 to be introduced into the pocket defined by the pair of fingers 348 and impinge or break the light beam. As soon as the syringe 10 breaks the light beam, the sensor device 359 sends a control signal to the controller instructing the controller to deactivate the vacuum in the groove 334 that carries the syringe 10 that has entered the pocket and broken the light beam. The deactivation of the vacuum source eliminates the mechanism that retains the syringe 10 within the groove 334 and therefore, once the vacuum is eliminated, the syringe 10 is free to and as a result of gravitational forces, the syringe 10 falls and clears the groove 334 and is captured within the pocket defined by the fingers 348. The vacuum dial 332 is then preferably advanced to the next index position and the process is repeated.

The controller can be configured so that when the vacuum dial 332 is advanced after one syringe 10 has been deposited into one respective pocket (defined by the pair of fingers 348), the controller sends a control signal to the vacuum source and/or the vacuum dial 332 resulting in the vacuum being reactivated in the groove 334 from which the syringe 10 has just left at the immediately preceding index position of the vacuum dial 332. This empty groove 334 is thus ready to receive another syringe 10 when it is advanced to a receiving position adjacent the first transport device 320.

While the exemplary sensor device 359 is one which emits a beam or the like (e.g., infrared beam), it will be appreciated that any number of other types of sensor devices 359 can be used so long as the sensor device 359 can detect the presence of the syringe 10 within the pocket. A preferred mounting location for the sensor device 359 is along one of the belts 344, 345 at a location between adjacent fingers 348 that form one member that receives the syringe 10. In the exemplary arrangement, the syringe 10 is deposited from the vacuum dial 332 to the pocket defined by the fingers 348 when the syringe 10 is advanced to the 6 o'clock index position on the vacuum dial 332, while the fingers 348 are in a 12 o'clock position relative to the drive roller 346. Once the syringe 10 is disposed within and securely held by the opposite pairs of fingers 348, the second transport device 340 advances the syringe 10 from the index station 330 to the web application station 350 by means of the movement of the belts 344, 345.

Referring to FIGS. 1 and 6–11, the web application station 350 is the station where two web layers (e.g., tapes) are disposed on the ordered, spaced apart syringes 10 for forming a bandoliered structure. One exemplary web application station 350 includes a first web source 352 disposed on one side of the belts 344, 345 and a second web source 354 disposed on another side of the belts 344, 345.

The first web source 352 is a roll of web material that is operatively coupled to a first support member 355 and is positioned above the top surface of the belts 344, 345 such that the first web source 352 is generally disposed between the belts 344, 345. In other words, the width of the first web roll 352 is less than a distance between the belts 344, 345. The first support member 355 can be any number of types of support members so long as it can support the first web roll 352 and permit the free rotation thereof for unwinding thereof. In the illustrated embodiment, the first support member 355 is a vertical support post or beam that has a boss or the like 358 formed at a distal end thereof. When the first web roll 352 is coupled to the support member 355, the boss 358 is received in an opening formed through a core of the first web roll 352 that has the first web material wound therearound. The first web roll 352 is arranged so that a free end thereof is unwound from the first web roll 352 at a lower section thereof (e.g., between the 4 and 6 o'clock positions of the first web roll 352) and is directed to one face of the spaced syringe barrels 20 as described below.

Similarly, the second web source 354 is a roll of web material that is operatively coupled to a second support member 357 and is positioned below the bottom surface of the belts 344, 345 such that the second web roll 354 is disposed directly between the belts 344, 345. In the illustrated embodiment, the second support member 357 is also a vertical support post or beam that has a boss or the like 358 formed at a distal end thereof for carrying the second web roll 354 in the manner described above. In the exemplary embodiment, the first and second support members 355, 357 are formed as a single integral vertical support post with the first member 355 being the upper half thereof and the second member 357 being the lower half thereof. The second web roll 354 is arranged so that a free end thereof is unwound from the second web roll 354 at an upper section thereof (e.g., between the 10 and 2 o'clock positions of the second web roll 354) and is directed to an opposite face of the spaced syringe barrels 20 as described below. It will be appreciated that the boss 358 associated with the second support member 357 is disposed below the belts 344, 345 since it extends inwardly toward the belts 344, 345 and therefore, cannot come into contact thereof. Thus, the center of the second web roll 354 lies below the belts 344, 345. For simplicity, FIG. 6 does not show any additional support structure that is attached to the support members 344, 345; however, it will be appreciated that an additional support structure can be attached thereto to support and hold the support members 344, 345 in the illustrated position. It will be appreciated that the web materials 352, 354 are fed so that the adhesive side of each web material faces a respective side of the syringe barrel 20.

The web application station 350 also includes equipment for pressing the web material 352, 354 onto the syringe barrels 20 as the web material 352, 354 is dispersed and more specifically, the equipment includes a plurality of programmable web press units, namely a first web press 360, a second web press 362, a third web press 364, and a fourth web press 366 that are each orientated on both sides (e.g., underneath and above) of the syringes 10. In other words, the first web press 360 is actually formed of two parts, namely a first component that is disposed above the belts 344, 345 and a second component that is disposed below the belts 344, 345. The other web presses 362, 364, and 366 have an identical arrangement in that each includes a first component disposed above the belts 344, 345 and a second component that is disposed below the belts 344, 345. Each of the web presses 360, 362, 364, and 366 consists of an actuator 370 and a web press head 372 that is coupled thereto for contacting and pressing the web material against a respective syringe barrel 20. More specifically, one exemplary actuator 370 is a pneumatic cylinder that is in communication with a programmable control so that the activation of the actuators 370 results in the controlled pressing of the web material 352, 354 against the syringes 10. The web press head 372 is coupled to the actuator 370 by an elongated rod or the like 374 that is movable relative to the actuator housing so as to permit the extension and retraction of the web press head 372.

The web press head 372 is a contoured head that has features formed therein to permit it to seat against the syringe barrel 20 with the web material being disposed therebetween, resulting in the web material being securely attached to the syringe barrel 20. More specifically, the web press head 372 has a longitudinal groove 376 formed therein along a bottom surface 378 thereof and extending a length thereof. The groove 376 has a shape that is complementary to the shape of the syringe barrel 20 so that when the web press head 372 is driven towards the syringes 10, with the web material disposed therebetween, a section of the syringe barrel 20 is received within the groove 376. Because the syringe barrel 10 is generally cylindrical in shape, each of the grooves 376 has a generally semi-circular shape. The bottom surface 378 also includes contact surfaces 380 formed on either side of the open groove 376 such that when the web press head 372 engages the syringe 10, the contact surfaces 380 are disposed on either side of the syringe barrel 20. It will be appreciated that the contact surfaces 380 serve to press the web materials 352, 354 into contact with one another in locations between the syringe barrels 20. As shown in the figure that depicts the syringe barrel 20, the direct interface locations between the two opposing adhesive sides of the web materials 352, 354 are formed between the syringe barrels 20. In other words, the web materials 352, 354 are directly attached to opposing sides of the syringe barrels 20 and as the web materials 352, 354 follow the curved syringe barrel 20, the web materials 352, 354 converge to one another and come into contact with one another at or near the outer surface of the syringe barrel 20. As previously mentioned, one exemplary web material is a tape material that has an adhesive material disposed on one face thereof to provide a surface that bonds to another surface, such as the plastic syringe barrel 20 or the opposing adhesive face of the other web material.

The web presses 360, 362, 364, and 366 are arranged so that when the respective web press heads 372 are in either the extended or retracted positions, the web press heads 372 are disposed closely adjacent one another so that there is little if any gap between the web press heads 372 in either of these two positions. When the four web press heads 372 are all aligned with one another, the four heads 372 look like a single, relatively seamless block with four spaced grooves 376 formed therein. The overall dimensions of each web press head 372 is such that a length of the press head 372 is less than a length of the syringe barrel 20 and more specifically, when the press head 372 seats against the syringe barrel 20, the press head 372 is disposed between the tip cap and the flange 25 and because the web material is fed underneath the press head 372, the width of the web material is equal to or less than the length of the press head 372. For each of the web presses 360, 362, 364 and 366, the two press heads 372 thereof are in axial alignment with one another such that activation of the press heads 372 results in each pair of press heads 372 encapturing one syringe barrel 20 between the grooves 376, with the longitudinal edges of the press heads 372 being adjacent one another except for the two ends of the first and fourth presses 360, 366.

When the press heads 372 of the presses 360, 362, 364, 366 are in the extended positions, the longitudinal edges of the press heads 372 meet one another at a location that is approximately a middle point between adjacent syringe barrels 20. In other words, the width of each press head 372 is such that each press head 372 extends beyond the syringe barrel 20 a distance that is approximately ½ of the distance between the innermost surfaces of two adjacent syringe barrels 20.

The web material is preferably a thin flexible film and therefore, when the two opposing web materials are attached to one another, the interconnected web section between the syringe barrels 20 is flexible, thereby permitting the web section to be readily bent or folded between the syringe barrels 20. This permits the bandoliered syringes to be disposed in packaging or the like in a folded, stacked manner.

The programmable controller 500 is in communication with all of the equipment that makes up the present system so that the system 300 can be operated in a controlled manner. For example and as previously mentioned, one preferred operating method is for the web presses 360, 362, 364, 366 to be sequentially activated so that the press heads 372 are sequentially brought into contact with the web material that is disposed thereunderneath and then moved into a position where the press heads 372 rest against the corresponding syringe barrels 20. The first web press 360 is the one farthest away from the first and second web rolls 352, 354, while the fourth web press 366 is closest to the first and second web rolls 352, 354. In the exemplary pressing operation, the two actuators 370 of the first web press 360 are activated and the two associated press heads 372 are moved into position against one syringe barrel 20 that is disposed therebetween. It will be appreciated that the contact surfaces 380 of the press head 372 serve to join the web materials 352, 354 on a leading side (farther from the web rolls 352, 354) of the syringe barrel 20 and on a trailing side (closer to the web rolls 352, 354) of the syringe barrel 20. Next, the two actuators 370 of the second web press 362 are activated and the two associated press heads 372 are moved into position against another syringe barrel 20 that is immediately adjacent the one encaptured by the press heads 372. This results in additional length of the web materials 352, 354 being pressed together around the syringe barrel 20 as well as the web sections between the syringe barrels 20. The press heads 372 of the web presses 360, 362 remain in the extended position while the two actuators 370 of the third web press 364 are activated and the two associated press heads 372 are moved into position against another syringe barrel 20 that is immediately adjacent the one encaptured by the press heads 372 of the second web press 362. This results in additional length of the web materials 352, 354 being pressed together around the syringe barrel 20 as well as the web sections between the syringe barrels 20. Lastly, the press heads 372 of the web presses 360, 362, 364 remain in the extended position while the two actuators 370 of the fourth web press 366 are activated and the two associated press heads 372 are moved into position against another syringe barrel 20 that is immediately adjacent the one encaptured by the press heads 372 of the third web press 364. This results in additional length of the web materials 352, 354 being pressed together around the syringe barrel 20 as well as the web sections between the syringe barrels 20. In this fully extended position, all of the heads 372 of the web presses 360, 362, 364, 366 are disposed against the syringe barrels 20 as well as against the web materials 352, 354 that are located at the leading web edge of the 4 interconnected syringe barrels 20, the joined web sections between the syringe barrels 20 and the trailing edge of the 4 interconnected syringe barrels 20. The purpose of maintaining the previously activated press heads 372 in the fully extended position while the next actuators 370 are activated is to ensure that the web material and bandoliered syringes do not lift up from the belts 344, 345 or otherwise become dislodged from the fingers 348.

In this exemplary embodiment, the web pressing equipment is generally a stop and go motion machine in that as the syringes 10 pass under the tape presses, sequentially from the first web press 360 to the fourth web press 366, the syringes 10 are bandoliered by securely attaching the web material to the syringes 10. The web application station 350 is a single station operation with the tape press equipment being aligned stationary relative to the belts 344, 345 and therefore, the bandoliering process is performed by advancing the syringes 10 and the web materials 352, 354 and then activating the web press equipment in a prescribed manner.

Preferably, the system 300 includes a number of locating and guide features that help align the web material. For example, a first web guide and retainer 600 is disposed proximate to the upper and lower components of the first web press 360 and a second web guide 610 is disposed between the first and second web rolls 352, 354 and the upper and lower components of the fourth web press 366. The second web guide 610 is generally constructed so that it guides both the first and second web rolls 352, 354 to the web presses 360, 362, 364, 366 and maintains a predetermined amount of tension on the web rolls 352, 354 to ensure that the web rolls 352, 354 maintain their proper alignment as the web material is guided to the four tape presses. In one exemplary embodiment, the second web guide 610 is in the form of a pair of relief idlers that are positioned in the appropriate location so as to interact with the web material 352, 354 as it is unrolled from its respective source and pulled in a direction away from the web sources as the syringes 10 are carried in this direction due to advancement of the belts 344, 345. Each of the relief idlers serves to guide the respective web material and applies the proper amount of tension thereto to ensure that the web material remains under sufficient tension to eliminate slacking and assist in guiding the web material, while at the same time, the tension is not too great so as to stretch, break or otherwise damage the web material.

The first web guide and retainer 600 has some similar features compared to the second web guide 610 and further includes additional features. The first web guide and retainer 600 is located proximate the first web press 360 in locations that are above and below the upper sections of belts 344, 345 (e.g., below and above the syringe barrels 20). In addition to positioning the web materials 352, 354 in a proper alignment relative to the press heads 372 of the four web presses 360, 362, 364, 366, the second web guide 610 also serves to initially retain the free end of the web materials 352, 354 before the press heads 372 of the first web press 360 are activated. In one exemplary embodiment, the second web guide 610 is a clip type device that holds the free ends of the web materials 352, 354 in a desired location so that the press heads 372 of the first web press 360 can be brought into contact with the web materials 352, 354 to begin the bandoliering process. This initial step is thus a manual step that is performed to ensure that the beginning free ends of the web materials 352, 354 are properly aligned and positioned with respect to the press heads 372 before the operator initiates the automated bandoliering process. In one embodiment, a first clip member is disposed above the syringe bodies 20 near first web press 360 and a second clip member is disposed below the syringe bodies 20 near the first web press 360. When the free ends of the web materials 352, 354 are fed into the first and second clip members and clipped therein, the web materials 352, 354 are properly positioned so that they extend intimately across the respective press heads 372 and are thus, aligned with respect to the portions of the syringe barrels 20 to which the web materials 352, 354 are disposed on.

After the operator has manually inserted the web materials 352, 354 into the first and second clip members, the bandoliering process is initiated by activating the first web press 360 so that the two press heads 372 move to the fully extended position resulting in the web materials 352, 354 being pressed into adhesive contact with the syringe barrel 20 and also into contact with each other. As mentioned above, the other web presses 362, 364, 366 are sequentially activated so as to press additional length of the web materials 352, 354 together to bandolier the syringes 10. The press heads 372 of the four web presses 360, 362, 364, 366 are then held in the fully extended position for a period of time and during this time, the operator cuts the web materials 352, 354 at a point between the first web press 360 and the first web guide and retainer 600 so as to free the bandoliered syringes 10 from the first web guide and retainer 600. After this initial one time cut is done and the web heads of the web presses 360, 362, 364, 366 are brought back to the fully retracted position, the belts 344, 345 are advanced and the four bandoliered syringes are advanced away from the tape application station 350. It will be appreciated that the entire system is indexed so that the belts 344, 345 are advanced a prescribed distance to position four syringes 10 in proper axial alignment with the four web presses 360, 362, 364, 366 and permit the web pressing operation to be performed in the manner described above. In other words, the belts 344, 345 are driven at select intervals and for a select time to cause four new syringes 10 to be delivered to the web application station 350 where the process is repeated.

Figure 12:
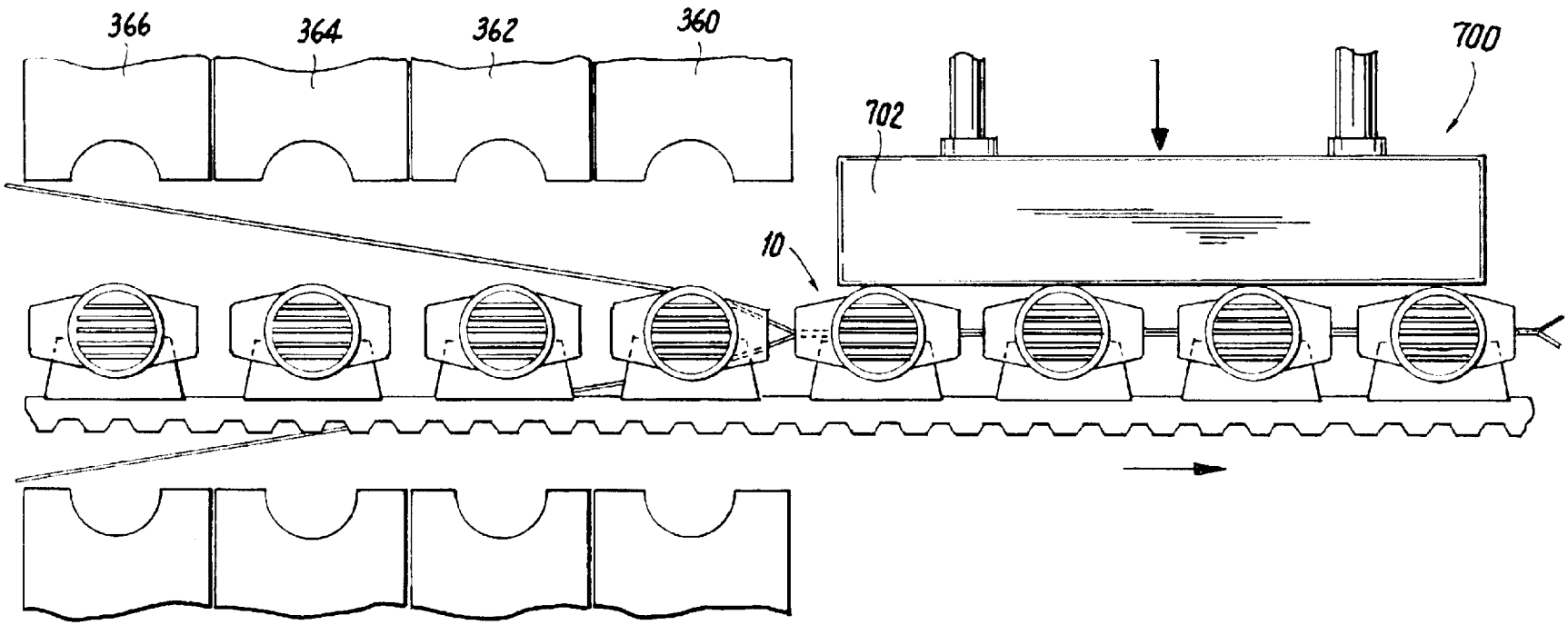
FIG. 12 is a side elevation view of the web application station illustrating the tape applicator mechanism in a fully retracted position with the banded section being advanced to a mechanism that ensures the banded syringes remain on the transport mechanism.

Preferably and as illustrated in FIG. 12, the system 300 also includes a mechanism 700 for ensuring that the just bandoliered syringes remain held between the fingers 348 and against the belts 344, 345 as they are advanced away from the web application station 350. The mechanism 700 is thus designed to apply a sufficient force to the bandoliered structure to ensure that the bandoliered structure does not lift off or otherwise become dislodged from its position along the belts 344, 345 and within the fingers 348. One exemplary mechanism 700 includes an extendable/retractable block member 702 that contact and applies a slight force against the syringe barrels 20 that were just bandoliered in the web application station 350 that is upstream therefrom. Accordingly, the block member 702 has a length that is sufficient so that it can seat against the four spaced syringe barrels 20 that were just bandoliered in the web application station 350. One exemplary block member 702 is made of a resilient material, such as rubber, and has a generally rectangular shape that permits the syringe 10 to be held and retained down against the belts 344, 345.

The mechanism 700 only needs to be disposed in one location, namely in a location that is above the bandoliered syringes 10 so that when the block member 702 is activated and driven in a direction towards the belts 344, 345, the block member 702 is brought into contact with the bandoliered syringes 10. Preferably, the mechanism 700 communicates with the controller 500 so that the entire system is indexed and therefore, the block member 702 retracts and is free of contact with the syringes 10 when the belts 344, 345 move to transport the four newly bandoliered syringes 10 from the web application station 350. When the belts 344, 345 are driven to advance the downstream syringes 10 to the tape application station 350 for bandoliering thereof and then stop when the syringes 10 are in place and aligned with the web presses 360, 362, 364, 366, the block member 702 is brought to its fully extended position into contact with the syringes 10. The mechanism 700 is located so that it holds the four syringes 10 that were just bandoliered because this is the location where it is most undesirable to have any sort of lifting of the syringes 10 away from the belts 344, 345 since lifting of the syringes 10 in this location can result in the lifting of the web materials 352, 354 in the tape application station 350 which is undesirable since it can lead to improper alignment of the web materials 352, 354 during the web pressing operation.

The control feature 900 ensures that the banded syringes 10 is properly aligned in a system that it is being used in, such as the disclosed automated system 100 (FIG. 14), and also to ensure that the syringes have specifications, e.g., dimensions, that fall within the acceptable specifications of the system with which the banded syringes 10 are being used. The control feature 900 is formed in each prescribed interval 902 between next adjacent syringes. The control feature 900 is configured so that a detection mechanism, such as a reader or other type of similar device, can detect the presence or absence, as well as the location of the control feature 900 within the prescribed interval 902.

Figure 13:
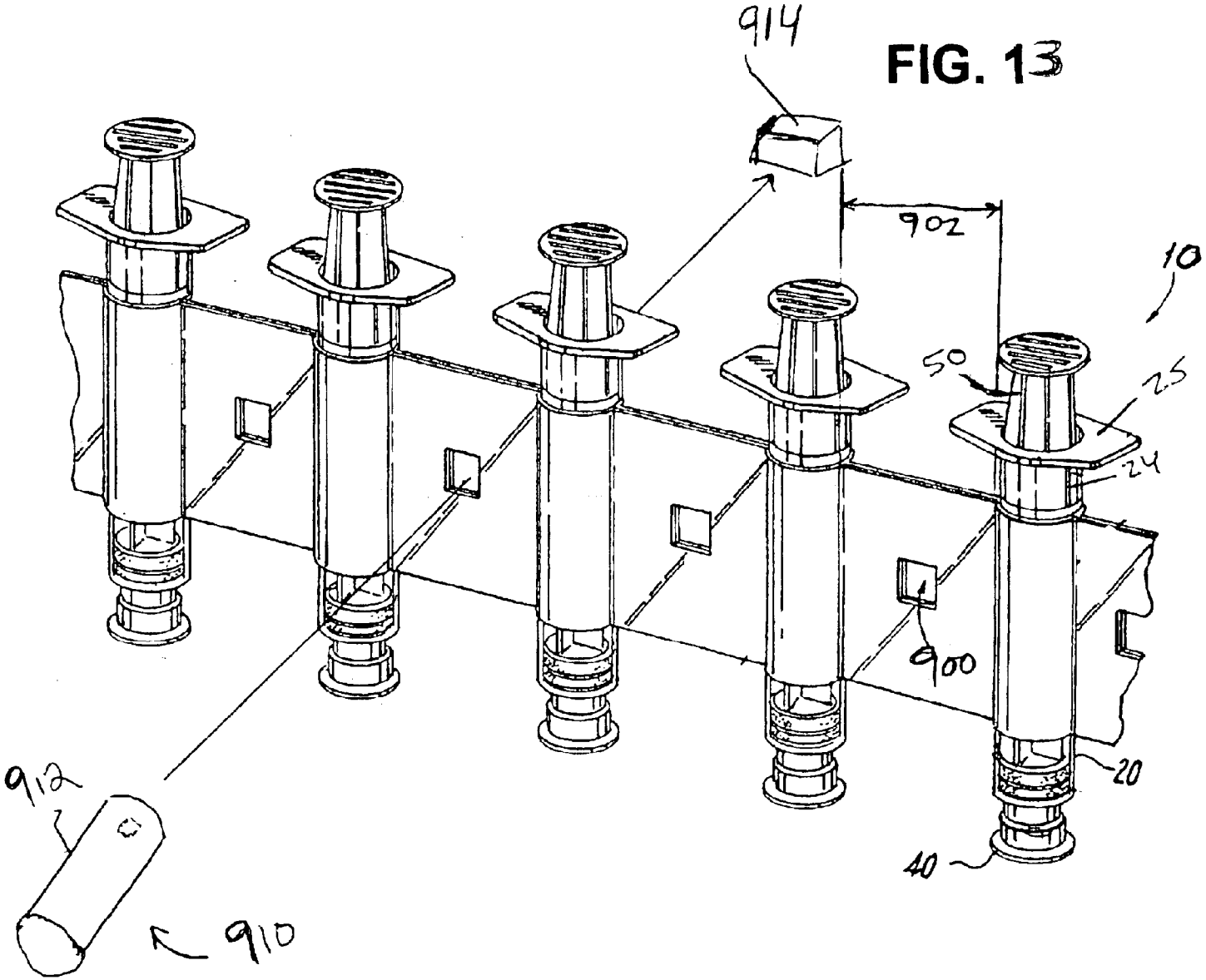
FIG. 13 is a side perspective view of a section of banded syringes with a control feature according to a first embodiment.

In one embodiment, the control feature 900 is an aperture formed in the prescribed interval 902 at a specific location thereof. For example, the control feature 900 can be in the form of an aperture having a square shape as shown in FIG. 13. The system 100 (FIG. 14) typically includes a laminar flow of air about the stations and rotary apparatus 130 to ensure that the system 100 is clean and remains in a clean state during operation. In a first embodiment, a detection mechanism 910 takes advantage of the presence of this laminar air flow by incorporating a nozzle 912 into the components providing the laminar air flow in the system 100. The nozzle discharges a laminar air flow and if the banded syringes 10 is precision fed into the system 100, proper alignment of the control feature 900 results and hence the syringe can be ascertained by having the laminar air flow directed toward the banded syringes 10 at the same height as the height that the control feature 900 is formed in the prescribed interval 902. In other words, the laminar air flow is in registration with the control feature 900 at select times when the aperture and the laminar air flow align with one another. When the control feature 900 (aperture) and the laminar air flow are not in alignment, the laminar air flow simply strikes the strip and does not pass therethrough.

In this embodiment, the detection mechanism 910 also includes a sensor 914 that is disposed on the opposite side of the banded syringes 10 as compared to the nozzle 912. The sensor 914 is configured to detect the presence of the laminar air flow when the aperture and laminar air flow are in alignment. In this instance, the sensor 914 is of a type that detects the presence of the laminar air flow against the sensor 914 itself and in one embodiment, the sensor is a pressure sensor. When the laminar air flow and the control feature 900 are in registration, the laminar air flow is permitted to flow cleanly through the aperture formed in the banded syringes 10 and make contact with the sensor. The sensor detects the presence of the laminar air flow and signals a controller (not shown) or the like of such detection. The controller is integrated into the system 100 such that upon receiving this signal, the controller then signals other components, such as the rotary apparatus 130, of the system 100 to advance the banded syringes 10 a prescribed distance. It should be understood that the controller can respond to the pressure of the air flow through the control feature 900 or to a logical waveform resulting from the timing of air signals relative to periods without air signals (e.g., due to indexing of the banded syringes 10).

Once the banded syringes 10 is advanced the prescribed distance, another of the apertures (control feature 900) is then axially aligned with the laminar air flow so long as the correct type of banded syringes 10 for the system 100 is in place, the syringe orientation (up or down) is proper, and also the alignment of the banded syringes 10 is proper. By integrating the detection mechanism 910 with the indexing components of the system 100, the distance between the control features 900 corresponds to the distance that the banded syringes 10 is advanced upon receiving the control signal from the detection mechanism 910. Thus, the banded syringes 10 is continuously advanced because each time the detection mechanism 910 is in recognition with the control feature 900, the banded syringes 10 is advanced a distance that corresponds to the next control feature 900 being within a detection zone, thereby resulting in the detection mechanism 910 detecting the next control feature 900 and signaling the system 100 to further advance the banded syringes 10.

It will be appreciated that the system 100 can thus easily be designed so that the banded syringes 10 is continuously fed into the system 100, thereby permitting the system 100 to run continuously. The control feature 900 ensures proper alignment of the banded syringes 10 and also ensures that the proper type of banded syringes 10 is being used as the system 100 is configured to stop advancing the banded syringes 10 if the detection mechanism 910 fails to read the control feature 900. For example, if the correct banded structure 10 is being used but the banded structure 10 becomes misaligned as it is being fed, the control feature 900 will not be in alignment with the nozzle as the banded syringes 100 are advanced. The detection mechanism 910 is preferably configured so that it will only advance the banded syringes 10 a predetermined distance without detecting the control feature 900. If the control feature 900 is not detected over this predetermined distance, the detection mechanism 910 signals the controller or the like of the system 100 to stop advancement of the banded syringes 10. Preferably, an error message is generated at the same time the banded syringes 10 is stopped. Manual inspection is then performed to locate the problem.

Figure 15:
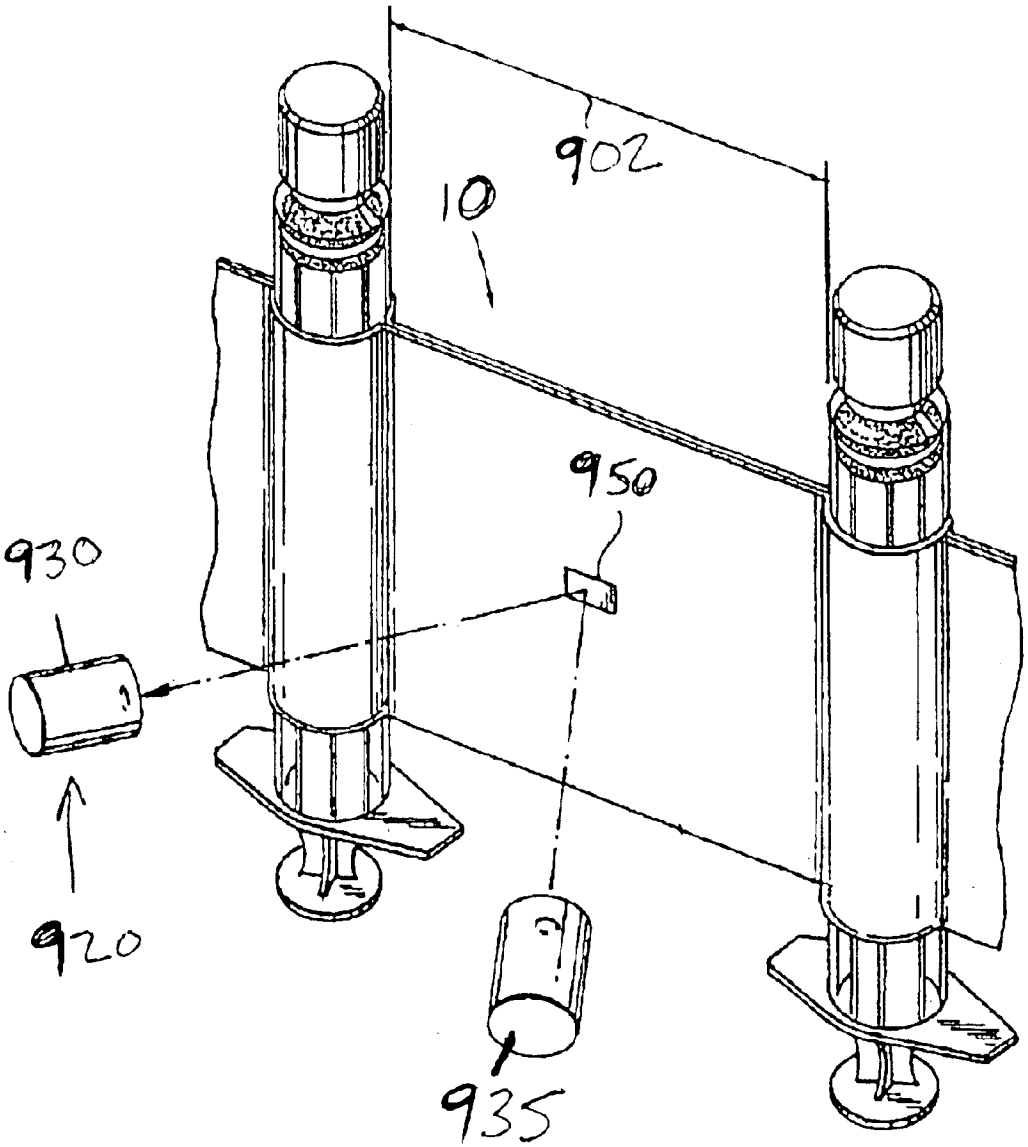
FIG. 15 is a side perspective view of a section of banded syringes with a control feature according to a second embodiment.

In another embodiment shown in FIG. 15, the control feature is in the form of an optical feature 950 that is used as part of an optical detection mechanism 920. As with the prior embodiment (FIG. 13), the optical feature 950 is formed in the prescribed region 902 of the banded syringes 10 with next adjacent optical features 950 being spaced a prescribed distance from one another.

Any conventional optical feature 950 that is suitable for use in the present application can be used. The detection mechanism 920 is a detection mechanism that optically detects the presence of the optical feature 950 when the optical feature 950 is in proper registration with an optical detector 930. For example, the optical detection mechanism 920 can include the optical detector 930 that faces the banded syringes 10 as the banded syringes are advanced. The optical detector 930 cooperates with a light source, such as a laser or LED 935 that also faces the banded structure 10 to detect the presence of the optical feature 950. Advantageously, the light source and optical detector are arranged relative to each other in accordance with Snell's Law of Reflection; however, the light source and detector can be arranged otherwise, such as normal to and facing the optical feature 950. The optical feature 950 can come in a number of different shapes and sizes.

The optical detection mechanism 920 operates essentially in the same manner as the detection mechanism 910 of FIG. 15. In other words, the banded syringes 10 are only advanced if the optical detection mechanism 920 reads the optical feature. If the banded structure 10 is advanced a prescribed distance and the optical detection mechanism 920 does not read the optical feature 950, the advancement of the banded structure 10 is stopped. Accordingly, proper registration between the optical features 950 and the detection mechanism 920 is needed for the banded structure 10 to be continuously advanced.

Figure 16:
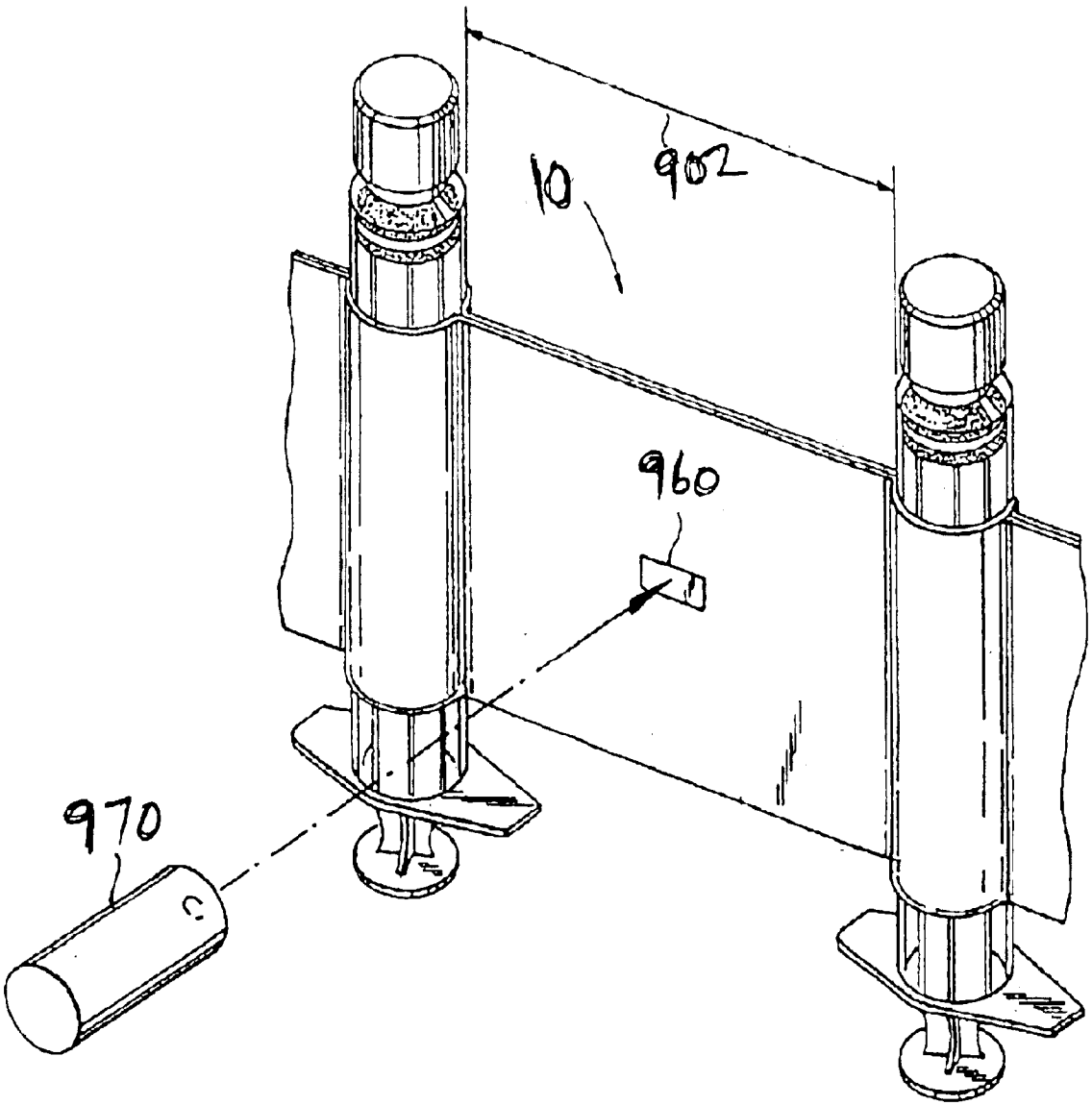
FIG. 16 is a side perspective view of a section of banded syringes with a control feature according to a third embodiment.

In yet another embodiment that is illustrated in FIG. 16, the control feature is a mark 960 that is formed within the prescribed interval 902 between spaced syringes and a detection mechanism 970 is used for detecting the mark 960. The mark 960 can be any number of types of marks, including a printed mark that is formed on the surface of banded syringes 10. As with the other embodiments, the detection mechanism 970 is used to detect the mark 960 and if a detection is not made within a prescribed time interval or during advancement of the banded structure 10 over a prescribed distance, the detection mechanism 970 signals a controller or the like to stop the advancement of the banded syringes 10.

It will also be appreciated that when the control feature is an aperture formed through the banded syringes 10 within the prescribed region, other types of detection mechanisms can be used rather than the pressure based detection mechanism discussed earlier. For example, the detection mechanism can be an ultrasonic system having an ultrasonic receiver and transducer. Ultrasonic waves are created one side of the banded syringes 10 and are emitted toward the banded syringes 10. When the control feature is in proper registration, the ultrasonic waves can pass through the aperture unimpeded and are detected on the other side of the banded syringes 10. When the detection mechanism is ultrasonically based, the system preferably includes an integrator and comparator so that ultrasonic waves that pass through the aperture can be differentiated from ultrasonic waves that reach the detector by means other than passing through the aperture (control feature).

Another type of detection mechanism that can be used with the banded syringes 10 is a thermal detection system. For example, the control feature 900 is still an aperture formed in the banded syringes 10; however, the detection mechanism is a thermal based system that includes a thermal source (e.g., heat lamp) and a thermal detector. The thermal source, such as a heat lamp, is disposed on one side of the banded syringes 10, while the thermal detector is disposed on the other side of the banded syringes 10. The thermal source and the thermal detector are positioned so that the aperture is in registration therewith at a point in time as the banded syringes 10 are advanced. The thermal detection mechanism is preferably coupled with an integrator and comparator. These two components permit the thermal detection mechanism to differentiate between heat that is detected across the aperture and heat that is detected through the banded structure 10 itself but outside of the aperture. Because heat that passes directly through the aperture is of higher intensity than heat that passes through the first and second layers of the banded syringes 10, the integrator/comparator can differentiate between the different thermal energies and only permit advancement of the banded syringes 10 when thermal energy passing through the aperture is detected.

Preferably, an ultrasonically, or heat or optically-based detection system includes logic such that the system does not merely detect ultrasonic waves, optical waves or heat waves but also analyzes the character, e.g., amplitude, of the waves. The detection system can therefore be configured to effectively filter out waves that do not meet certain criteria. The criteria is preferably a threshold that is achieved only when waves pass directly through the aperture (control feature) and are detected by the detection mechanism on the other side of the banded syringes 10. Thus, waves that do not pass through the aperture but are otherwise detected on the other side of banded structure 10 do not register as a detection since they lack the prescribed criteria.

The control feature can comprise a segment of web material that permits passage of heat or light (of a given frequency, for example) while the remainder of the strip is treated (e.g., coated) to block heat or light of prescribed frequencies. Thus, it can be appreciated that the control feature can take on a variety of forms to ensure proper handling of the bandolier type syringes.

After the belts 344, 345 are advanced again, the bandoliered syringes 10 that were being held down by the block member 702 are advanced four positions down the line and are not held down within the fingers 348 by any external member. Thus, after the syringes 10 depart the mechanism 700, the syringes 10 are not held down and some lifting of the syringes 10 may occur but at this location and downstream locations along the belts 344, 345, it is not as important for the syringes 10 to held completely down within the fingers 348.

The belts 345, 345 continue to the end that is opposite the end that where the index station 330 is located. At this end, the bandoliered syringes 10 can be further processed or manipulated in any number of different ways. For example, the bandoliered syringes 10 can be sent to a packaging station for packaging of the empty bandoliered syringes 10 or the syringes 10 can be delivered to an automated system where the syringes 10 can be filled with a medication or the like.

FIG. 13 illustrates an exemplary banded syringe structure produced in accordance with the present invention and includes a plurality of syringes 10 that each includes a barrel 20 having an elongated body 22 that defines a chamber 30 that receives and holds a medication that is disposed at a later time. The barrel 20 has an open proximal end 24 with a flange 25 being formed thereat and it also includes an opposing distal end 26 that has a barrel tip that has a passageway, that is an ANSI standard luer fitting, formed therethrough. One end of the passageway opens into the chamber 30 to provide communication between the barrel tip and the chamber 30 and the opposing end of the passageway 29 is open to permit the medication to be dispensed through a cannula (not shown) or the like that is later coupled to the barrel tip.

An outer surface of the barrel tip can include features to permit fastening with a cap or other type of enclosing member. For example, the outer surface can have threads that permit a tip cap 40 to be securely and removably coupled to the barrel tip or another type of fit can be formed, such as a press frictional fit. The tip cap 40 thus must have complementary fastening features that permit it to be securely coupled to the barrel tip. The tip cap 40 is constructed so that it closes off the passageway to permit the syringe 10 to be stored and/or transported with a predetermined amount of medication disposed within the chamber 30. As previously mentioned, the term "medication" refers to a medicinal preparation for administration to a patient and most often, the medication is contained within the chamber 30 in a liquid state even though the medication initially may have been in a solid state, which was compounded into a liquid state.

The syringe 10 further includes a plunger 50 that is removably and adjustably disposed within the barrel 20. More specifically, the plunger 50 is also an elongated member that has a proximal end that terminates in a flange 52 to permit a user to easily grip and manipulate the plunger 50 within the barrel 20. Preferably, the plunger flange 52 is slightly smaller than the barrel flange 25 so that the user can place several fingers around, against, or near the barrel flange 25 to hold the barrel 20 and then use the thumb of the certain hand to withdrawn or push the plunger 50 forward within the barrel 20. An opposite distal end of the plunger 50 terminates in a stopper or the like that seals against the inner surface of the barrel 20 within the chamber 30. The plunger 50 can draw a fluid (e.g., air or a liquid) into the chamber 30 by withdrawing the plunger 50 from an initial position where the stopper is near or at the barrel tip to a position where the stopper 59 is near the proximal end 24 of the barrel 20. Such steps may be performed either sequentially or simultaneously by the automated methods. Conversely, the plunger 50 can be used to expel or dispense medication by first withdrawing the plunger 50 to a predetermined location, filling the chamber 30 with medication and then applying force against the flange 52 so as to move the plunger 50 forward within the chamber 30, resulting in a decrease in the volume of the chamber 30 and therefore causing the medication to be forced into and out of the barrel tip.

The banded syringes 10 can include a control feature 900 such as the ones disclosed in commonly assigned pending U.S. patent application Ser. No. 10/001,244, filed Nov. 15, 2001, entitled "Syringe Bandolier with Control Feature, which is hereby incorporated by reference in its entirety.

Figure 14:
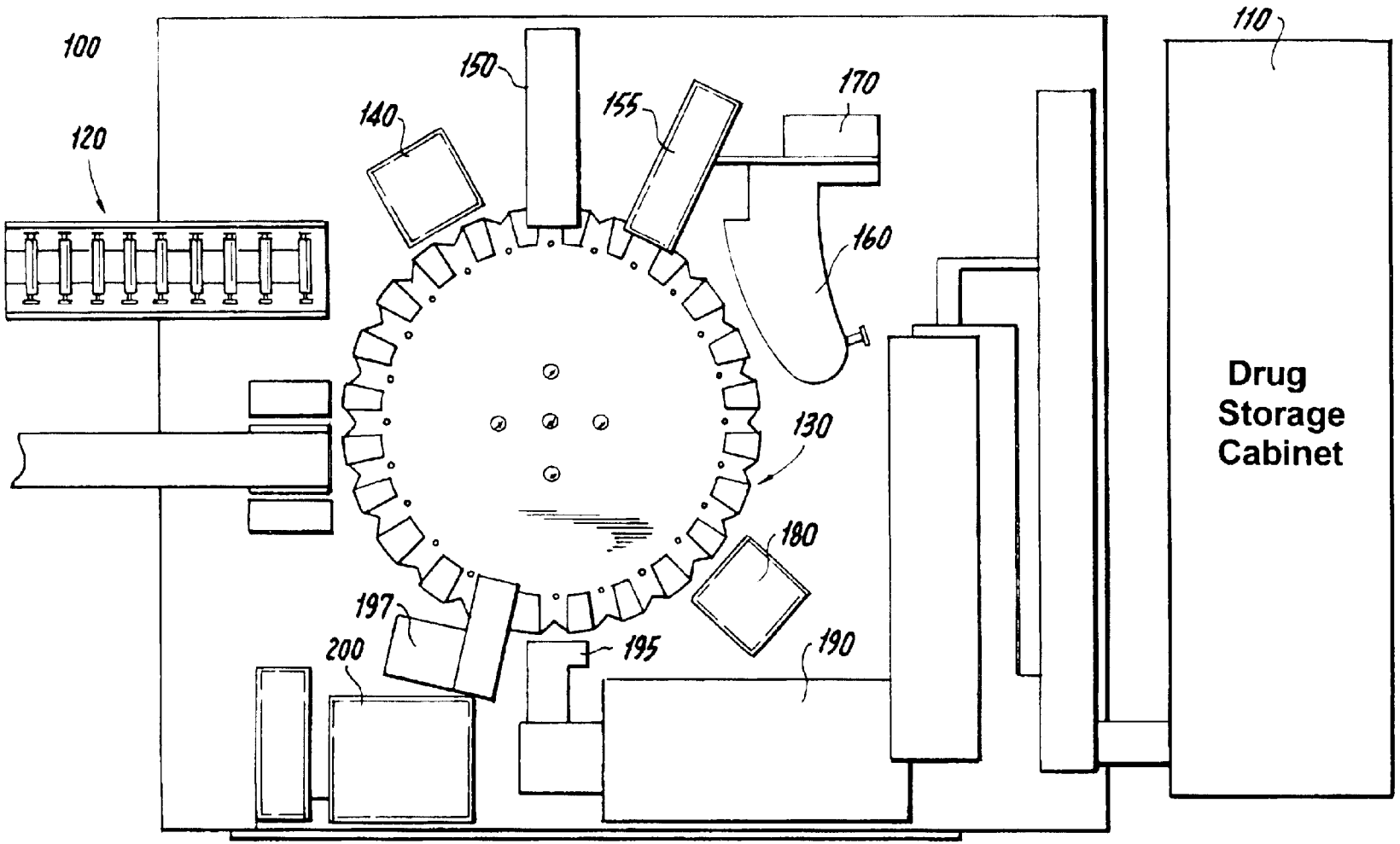
FIG. 14 is a diagrammatic plan view of an automated system for preparing or otherwise compounding a medication to be administered to a patient

In one exemplary application, the system 300 is used in combination with the automated system 100 of FIG. 14 that receives the bandoliered syringes and further processes them according to specific instructions that are inputted by an operator. FIG. 14 is a schematic diagram illustrating one exemplary automated system, generally indicated at 100, for the preparation of a medication, which is described in great detail in commonly assigned U.S. patent application Ser. No. 09/998,905, entitled Automated Drug Vial Safety Cap Removal, filed Nov. 30, 2001, which is hereby incorporated by reference in its entirety. The automated system 100 is divided into a number of stations where a specific task is performed based on the automated system 100 receiving user input instructions, processing these instructions and then preparing or compounding unit doses of one or more medications in accordance with the instructions. The automated system 100 includes a station 110 where medications and other substances used in the preparation process are stored. As used herein, the term "medication" refers to a medicinal preparation for administration to a patient. Often, the medication is initially stored as a solid, e.g., a powder, to which a liquid or fluid diluent is added to form a medicinal composition. Thus, the station 110 functions as a storage unit for storing one or more medications, etc. under proper storage conditions. Typically, medications and the like are stored in sealed containers, such as vials, that are labeled to clearly indicate the contents of each vial.

A first station 120 is a banded syringe preparation station that houses and stores a number of syringes and is described in great detail hereinafter. In one exemplary embodiment, the syringes are provided as a bandolier structure that permits the syringes to be fed into the other components of the system 100 using standard delivery techniques, such as a conveyor belt, guidance mechanism, etc.

The system 100 also includes a rotary apparatus (dial) 130 for advancing the fed syringes from and to various stations of the system 100. A number of the stations are arranged circumferentially around the rotary apparatus 130 so that the syringe is first loaded at a first station 140 and then rotated a predetermined distance to a next station, etc. as the medication preparation or compounding process advances. At each station, a different operation is performed with the end result being that a unit dose of medication is disposed within the syringe that is then ready to be administered.

One exemplary type of rotary apparatus 130 is a multiple station cam-indexing dial that is adapted to perform material handling operations. The indexer is configured to have multiple stations positioned thereabout with individual nests for each station position. One syringe is held within one nest using any number of suitable techniques, including opposing spring-loaded fingers that act to clamp the syringe in its respective nest. The indexer permits the rotary apparatus 130 to be advanced at specific intervals.

At the second station 140, the syringes are loaded into one of the nests of the rotary apparatus 130. One syringe is loaded into one nest of the rotary apparatus 130 in which the syringe is securely held in place. The system 100 preferably includes additional mechanisms for preparing the syringe for use, such as removing a tip cap at a third station 150 and extending a plunger of the syringe at another station 155. At this point, the syringe is ready to be filled.

The system 100 also preferably includes a reading device (not shown) that is capable of reading a label disposed on the sealed container containing the medication. The label is read using any number of suitable reader/scanner devices, such as a bar code reader, etc., so as to confirm that the proper medication has been selected from the storage unit of the station 110 (this function is preferably part of the labeled station in FIG. 14). Multiple readers, sensors, or other methods can be employed in the system at various locations to confirm the accuracy of the entire process. Once the system 100 confirms that the sealed container that has been selected contains the proper medication, the container is delivered to a fourth station 160 using an automated mechanism, such a robotic gripping device as will be described in greater detail. At the fourth station 160, the vial is prepared by removing the safety cap from the sealed container and then cleaning the exposed end of the vial. Preferably, the safety cap is removed on a deck of the automated system 100 having a controlled environment. In this manner, the safety cap is removed just-in-time for use.

The system 100 also preferably includes a fifth station 170 for injecting a diluent into the medication contained in the sealed container and then subsequently mixing the medication and the diluent to form the medication composition that is to be disposed into the prepared syringe. At a fluid transfer station, the prepared medication composition is withdrawn from the container (i.e., vial) and is then disposed into the syringe. For example, a cannula can be inserted into the sealed vial and the medication composition then aspirated into a cannula set. The cannula is then withdrawn from the vial and positioned using the rotary apparatus 130 in line with (above, below, etc.) the syringe. The unit dose of the medication composition is then delivered to the syringe, as well as additional diluent if necessary or desired. The tip cap is then placed back on the syringe at a sixth station 180. A seventh station 195 prints and applies a label to the syringe and a device, such as a reader, can be used to verify that this label is placed in a correct location and the printing thereon is readable. Also, the reader can confirm that the label properly identifies the medication composition that is contained in the syringe. The syringe is then unloaded from the rotary apparatus 130 at an unloading station 200 and delivered to a predetermined location, such as a new order bin, a conveyor, a sorting device, or a reject bin. The delivery of the syringe can be accomplished using a standard conveyor or other type of apparatus. If the syringe is provided as a part of the previously-mentioned syringe bandolier, the bandolier is cut prior at a station 197 located prior to the unloading station 200.

The system 100 preferably includes additional devices for preparing the syringe for use, such as removing a tip cap 40 of the syringe at a third station 150 and then placing or parking the tip cap 40 on the dial (rotary device) 130 of the automated system 100 having a controlled environment. In this manner, the tip cap 40 is removed just-in-time for use. The tip cap 40 is then placed back on the syringe at the sixth station 180. Additional details of the system 100 are disclosed in the above-reference patent application.

What is claimed is:

1. A method of banding a plurality of syringes comprising the steps of:

introducing the plurality of syringes into a feeder;

aligning the plurality of syringes in a predetermined arrangement and delivering the aligned syringes to a rotary device;

advancing and controlling the rotary device so that syringes held therein are successively delivered to a transport device that holds and maintains the syringes in a spaced relationship, advancing the transport device such that the syringes are delivered to a web application device;

activating the web application device to cause a first web material to be simultaneously applied to a first face of a group of syringes and a second web material to be applied to a second face of the group of syringes, the first and second web materials being pressed into contact with the first and second faces of the syringes, respectively, and into contact with each other in areas between the syringes so as to form a banded syringe structure; and advancing the banded syringe structure from the web application device.

2. The method of claim 1, wherein advancing the rotary device includes the step of advancing the rotary device one interval, while simultaneously advancing the transport device one unit such that the syringe departing the rotary device is transferred into an empty pocket formed along the transport device for retaining and holding the one syringe.

3. The method of claim 1, wherein activating the web application device comprises the steps of:

successively activating a plurality of press heads that form the web application device such that each press head presses one of the first and second web materials against one of the group of syringes; and holding each activated press head in the extended position until at least all of the press heads are activated and assume the extended position.

4. The method of claim 3, wherein the number of press heads is two times the number of syringes in the group of syringes.

5. The method of claim 3, further comprising the steps of:

initially feeding the first web material through a first web retainer that is upstream of the web application device and initially feeding the second web material through a second web retainer that is upstream of the web application device;

retaining the first and second web materials under tension within the first and second web retainers, respectively, prior to the step of advancing the transport device such that the syringes are delivered to a web application device; and cutting a banded section of the first and second web materials after the banded syringe structure is formed but before advancing the banded syringe structure from the web application device.

6. The method of claim 1, wherein the steps of introducing the syringes into a feeder and aligning the plurality of syringes in a predetermined arrangement and delivering the aligned syringes to a rotary device comprise the steps of:

introducing the syringes into a centrifugal bowl feeder which is activated resulting in the syringes being aligned in the predetermined arrangement; and receiving the aligned syringes from the bowl feeder through an exit port and into a feeder rail device;

activating the feeder rail device to cause it to linearly vibrate resulting in the syringes being transported a length of the feeder rail device to the rotary device.

7. A method of providing a banded syringe product comprising the steps of:

banding a plurality of syringes by aligning the plurality of syringes in a predetermined arrangement and simultaneously a first web material to a first face of the syringes and a second material to a second face of the syringes and pressing the first and second webs into contact with the syringes and into contact with each other in areas between the syringes so as to form a plurality of banded syringes; and providing a control feature in an area between the syringes, the control feature being different from the surrounding web material.

8. The method of claim 7, wherein the control feature is an aperture formed in the web material.

9. The method of claim 7, wherein there is a correlation between a location of the control feature in the prescribed interval and a type of syringe that is bound to the web material.

10. The method of claim 7, wherein the control feature is an optical feature formed on a surface of the web material.

11. The method of claim 7, further including the step of:

providing a detection system including a detector positioned to detect the control feature on the bandolier and perform a prescribed operation in response to the detection or non-detection of the control feature.

12. A system for banding a plurality of loose syringe barrels, the system including:

a feed device for receiving the plurality of loose syringe barrels;

an automated mechanism for receiving the loose syringe barrels and positioning the plurality of syringes according to a predetermined orientation;

an automated transfer device for transferring the plurality of syringes in the predetermined orientation to a transport device that receives and holds the syringes in a spaced relationship and moves them from one location to another location, the transfer device having individual pockets that each receives and holds one syringe; and a web application device disposed along the transport device for simultaneously applying a first web material to a first face of a predetermined number of syringes and a second web material to a second face of the syringes and then pressing the first and second materials into contact with the first and second faces of the syringes, respectively, and into contact with each other in areas between the syringes so as to form a banded syringe structure.

13. The system of claim 12, wherein the feed device includes a centrifugal bowl feeder that receives the plurality of loose syringes in a random manner and includes tooling that positions the plurality of syringes.

14. The system of claim 13, wherein the automated mechanism includes a first guide device for receiving the syringes from an exit port of the bowl feeder and delivering them to the transfer device in the predetermined orientation.

15. The system of claim 14, wherein the first guide device comprises a feeder rail that includes a drive feature for advancing the syringes from the exit port to the transfer device.

16. The system of claim 15, wherein the drive feature comprises a straight line drive unit that produces linear vibratory motion that results in the syringes being advanced sequentially along the feeder rail to the transfer device.

17. The system of claim 16, wherein the feeder rail includes a first side rail and a second side rail with a space being formed therebetween for receiving the syringes, each of the first and second side rails having a flange formed at an upper end thereof that extends inwardly toward the other flange, wherein the syringes hang within the feeder rail as a result of a syringe barrel flange seating against the flange of the feeder rail.

18. The system of claim 14, wherein the tooling includes an internal feed track and the transfer device includes a mechanism for disengaging the syringes from the feed track and directing them to the first guide device by generating a stream of air and directing it at the syringes.

19. The system of claim 12, wherein the transfer device comprises a rotary device that includes the individual pockets in the form of a plurality of individual receiving sections that receive the syringes in a manner in which each syringe is separated from the other and held within its own receiving section as the rotary device rotates to deliver the syringes from the feed device to the transport device.

20. The system of claim 19, wherein the receiving sections comprise a number of grooves formed radially around an outer edge of the rotary device which is in the form of a vacuum rotary device connected to a vacuum source, each of the grooves having a plurality of vacuum ports that are connected to the vacuum source such that negative pressure is selectively produced within the grooves.

21. The system of claim 20, wherein the rotary device is in communication with a controller that permits the vacuum source to be selectively disconnected from the vacuum ports of one of the grooves resulting in the disengagement of the syringe from the one groove.

22. The system of claim 12, wherein the transport device comprises a conveyor belt assembly that receives the syringes from the transfer device and delivers them to another location, the belt assembly including a first belt and a second belt spaced therefrom with a space being formed therebetween, the first and second belts having aligned features that receive and hold the syringes in a spaced relationship with a predetermined distance between adjacent syringes.

23. The system of claim 22, wherein the aligned features comprise a plurality of fingers that are formed as part of the first belt and the second belt with each pair of fingers on the first belt being aligned with an opposite pair of fingers formed on the second belt, one syringe being nested within the two pairs of opposite fingers with a barrel of the syringe extending across the space.

24. The system of claim 19, wherein the rotary device includes a number of grooves formed radially around an outer edge of the rotary device which is in the form of a vacuum rotary device connected to a vacuum source, each of the grooves having a plurality of vacuum ports that are connected to the vacuum source such that negative pressure is selectively produced within the grooves and the transport device comprises a conveyor belt assembly that receives the syringes from the transfer device and delivers them to another location, the belt assembly including a first belt and a second belt spaced therefrom with a space being formed therebetween, the first and second belts having aligned features that receive and hold the syringes in a spaced relationship with a predetermined distance between adjacent syringes, the transport device being disposed proximate the rotary device so that one groove is disposed above and in alignment with one aligned pair of belt features in a transfer position to permit transfer of one syringe.

25. The system of claim 24, wherein the rotary device and the transport device are indexed devices that communicate with a controller such that as the rotary device advances the syringes held therein are successively brought into alignment with an empty pocket defined by the aligned features and the controller instructs the vacuum source to be selectively disconnected from the groove in the transfer position.

26. The system of claim 12, wherein the web application device comprises one or more web presses that are disposed on opposite sides of the transport device such that the web application device presses the first web material against the first face of the syringes and presses the second web material against the second face of the syringes and into contact with each other in areas between the syringes so as to form the banded syringe structure.

27. The system of claim 26, wherein the one or more presses comprises four presses, each press having a first actuator with an associated first press head for pressing the first web material against the first face and a second actuator with an associated second press head for pressing the second web material against the second face, the four presses being disposed adjacent one another, each press being activated independently from the others so that the four presses are successively activated and moved into extended positions where the first and second web materials are pressed, thereby forming the banded syringe structure.

28. The system of claim 27, wherein each of the first and second actuators is a pneumatic cylinder that is operatively coupled to the first and second press heads, respectively.

29. The system of claim 27, wherein each of the first and second press heads has a longitudinal groove formed therein for receiving a barrel of the syringe when the press head is pressed against the syringe with the respective web material being disposed therebetween.

30. The system of claim 12, wherein the web application device comprises a pressing device that has a number of parts that are successively activated to press the first and second web materials to form the banded structure, each of the parts moving between an extended position wherein the part presses the respective web material into contact with one syringe and a retracted position where the part is spaced from the syringe.

31. The system of claim 30, further comprising at least one idler roll disposed between the first and second web materials and the web application device for applying and maintaining the first and second web materials under tension.

32. The system of claim 30, further comprising at least one web guide roll disposed proximate to and downstream of the web application device for initially receiving a free end of one of the first and second web materials, the web guide roll acting to hold and align the web material so that a length thereof is disposed underneath the parts of the web application device and axially aligned relative thereto and relatively to the syringe.

33. The system of claim 32, wherein the web guide roll comprises a clip that holds the free end of the web material to permit the pressing device to be activated resulting in the banding of a select group of syringes, the system including a cutter for cutting the first and second pressed web materials at a location upstream of the web application device and before advancement of the transport device.

34. The system of claim 12, wherein the first web source comprises a single side adhesive tape and the second web source comprises a single side adhesive tape.

35. A system for banding a plurality of syringe barrels, the system including:

a feed device for receiving the plurality of syringe barrels;

an index device for transferring the plurality of syringes to a transport device that includes individual pockets for receiving and holding the syringes in a spaced relationship as the syringes are advanced due to movement of the transport device; and a web application device disposed along the transport device for simultaneously applying a first web material to a first face of a predetermined number of syringes and a second web material to a second face of the syringes at the same syringe location, the web application device being configured to press the first and second materials into contact with the first and second faces of the syringes, respectively, and into contact with each other in areas between the syringes so as to form a banded syringe structure.

36. The system of claim 35, wherein the first and second faces are opposite one another.

37. The system of claim 35, wherein a guide mechanism guides the first web material across and above the first face of the syringes as well as guiding the second web material across and below the second face of the syringes.

38. The system of claim 35, wherein the web application device includes a plurality of independent parts that are controllable so that they can be successively moved from a retracted position to an extended position in which the parts apply pressure against the first and second web materials to produce the banded structure.

39. The system of claim 35, wherein the index device and the transport device are in communication with a controller that indexes the relative movements thereof, the transport device being advanced until a selected group of syringes are introduced into the web application device and then held for a period of time to permit the selected number of syringes to be banded after which time, the transport device is advanced so that a selected group of unbanded syringes is introduced into the web application device.

40. The system of claim 39, wherein the index device remains stationary for the period of time when the selected group of syringes is banded.

41. The system of claim 35, wherein the index device comprises a vacuum rotary device that is connected to a vacuum source and the syringes are selectively held within individual compartments of the index device, whereupon deactivation of the vacuum source in a selected individual compartment results in the syringe held therein being transferred by gravity to one of the individual pockets formed along the transport device.

42. The system of claim 41, wherein the index device is indexed so that movement thereof in one interval is performed simultaneous with the advancement of the transport device one unit such that the syringe departing the index is transferred into an empty pocket.

* * * * *